US006466001B2

(12) United States Patent
Hanazaki et al.

(10) Patent No.: US 6,466,001 B2
(45) Date of Patent: Oct. 15, 2002

(54) METHOD AND APPARATUS FOR CONTROLLING THE MOLTEN METAL LEVEL IN A MOLD IN CONTINUOUS CASTING

(75) Inventors: Kazuharu Hanazaki, Ibaraki (JP); Toshihiko Murakami, Ibaraki (JP); Masahiko Oka, Hyougo (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/739,870

(22) Filed: Dec. 20, 2000

(65) Prior Publication Data

US 2001/0002619 A1 Jun. 7, 2001

Related U.S. Application Data

(63) Continuation of application No. PCT/JP00/00398, filed on Jan. 27, 2000.

(30) Foreign Application Priority Data

Apr. 28, 1999 (JP) ..... 11-121152
Sep. 14, 1999 (JP) ..... 11-259973

(51) Int. Cl.[7] ..... G01R 23/16

(52) U.S. Cl. ..... 324/76.21; 324/76.22; 324/76.29

(58) Field of Search ..... 324/76.21, 76.19, 324/76.22, 76.29; 164/155.2, 449.1

(56) References Cited

U.S. PATENT DOCUMENTS 3,729,118 A * 4/1973 Wernali et al. ..... 222/595
4,175,612 A * 11/1979 Baumert ..... 324/236 X
4,210,192 A * 7/1980 Lavanchy et al. ..... 164/457
4,365,165 A * 12/1982 Vedova ..... 250/577
4,392,523 A * 7/1983 Beller et al. ..... 324/239 X
4,763,025 A * 8/1988 Takeuchi ..... 307/526
4,860,820 A * 8/1989 Pereira ..... 164/457
4,912,407 A * 3/1990 Gaultieri et al. ..... 324/204
5,629,870 A * 5/1997 Farag et al. ..... 324/76.21 X
5,699,849 A * 12/1997 Fink ..... 164/155.4
6,289,971 B1 * 9/2001 Kagawa ..... 164/449.1

FOREIGN PATENT DOCUMENTS

JP 05023811 A 2/1993
JP 08147044 A 6/1996

* cited by examiner

*Primary Examiner*—N. Le
*Assistant Examiner*—T. R. Sundaram
(74) *Attorney, Agent, or Firm*—Clark & Brody

(57) ABSTRACT

A method and apparatus for controlling the level of molten metal in a mold for continuous casting by using a molten metal level control system incorporating a molten metal level controller in the control loop thereof, which comprises damping selectively the predetermined frequency of frequencies of periodical molten metal level fluctuations through a notch filter installed in the control loop. The control loop preferably includes the phase compensation calculation part for compensating the phase delay of the stopper opening position control signal for adjusting the amount of the molten metal to be fed to the mold. The control apparatus in the control loop comprises a molten metal level senser, an FFT analyzer, an automatic tuning device for dealing with the results of the FFT analysis, a molten metal level controller and a notch filter.

30 Claims, 18 Drawing Sheets

PRIOR ART

METHOD AND APPARATUS FOR CONTROLLING THE MOLTEN METAL LEVEL IN A MOLD IN CONTINUOUS CASTING

This application claims priority under 35 U.S.C §§119 and/or 365 to Japan Patent Application No.11-121152 filed in Japan on Apr. 28, 1999, and No.11-259973 filed in Japan on Sep. 14, 1999, the entire content of which is herein incorporated by references. This application is a continuation of International Application PCT/JP00/00398, filed Jan. 27, 2000.

TECHNICAL FIELD

This invention relates to a method of controlling the level of molten metal in a mold in the process of continuous casting as caused by irregular slab bulging occurring in the secondary cooling zone and by the eccentricity of the pinch rolls and other rolls, to a control apparatus thereof and to a method of continuous casting of steel.

BACKGROUND ART

FIG. 1 is a schematic representation of a continuous casting machine and a system of controlling the level of the molten metal in a mold, which is in conventional use.

Molten steel 1 poured into a mold 4 through a tundish 2 and a submerged entry nozzle 3 is cooled in the mold 4, whereupon a solidified shell 6 is formed. The solidification of the liquid core 7 within the solidified shell progresses and a slab 5 is formed. The slab is supported by a plurality of guide rolls 8 in the secondary cooling zone and continuously withdrawn downward by means of a plurality of pinch rolls equipped with drive motor 10.

The molten metal level in a mold is controlled in the following manner. The level of molten steel 1 is detected by a molten metal level detector 11, and a molten metal level controller 12 performs its control function according to a control logic, namely by means of proportional positions and integral motions, and drives, by using a stopper driving device 13, a stopper 14 to thereby control the rate of inflow of molten steel 1 so that the deflection from a set value of the molten metal level may become zero. In this manner, the molten metal level is maintained at a set value even when the casting condition is changed or clogging of the submerged entry nozzle 3 occurs.

FIG. 2A and FIG. 2B schematically illustrate how irregular bulging occurs. FIG. 2A shows the case of slab swelling and FIG. 2B shows the case of slab shrinking.

While, as shown in FIG. 2A, the solidified shell 6 of the slab 5 is not yet sufficiently thick, the slab 5 is apt to deform and may swell between the secondary cooling zone guide rolls 8 under the static pressure of the molten steel. When the rate of the feeding of the molten steel to the mold is constant, the molten steel level falls as shown by the arrow A. When the thickness of such a swelled slab is restored to its original thickness by secondary cooling zone guide rolls 8, the molten steel level rises.

Thus, when the slab 5 deforms easily, the portion that has once swelled is again pressed by the secondary cooling zone guide rolls 8, while the portion that is now out of contact with the secondary cooling zone guide rolls 8 swells. The molten metal level in the mold 4 will not change, if the amount of transfer of molten steel 1 in the liquid core 7 on the occasion of slab bulging is equal to the amount of molten steel 1 in the liquid core 7 on the occasion of the slab being pressed.

If, however, the casting proceeds, for some cause or other, in a manner such that the slab 5 solidifies while maintaining wavy bumps thereon, the crest-forming portions are pressed by secondary cooling zone guide rolls 8, as shown in FIG. 2B, therefore the volume of the slab shrinks, resulting in the molten metal level rising as indicated by the arrow B. This process is repeated and periodical molten metal level fluctuations occur in the mold at roll gap intervals. This state is called irregular bulging.

When this periodic change in molten metal level increases, the quality of the slab may deteriorate or a breakout may occur in some instances. Such irregular bulging may occur with a steel grade which has a high carbon content (peritectic steel) or a steel grade which has a high alloying element content. The "roll gap", so referred to herein, means the distance between two points in the central axis of the rolls in the direction of casting.

Meanwhile, all the roll gaps in the direction of the casting in the secondary cooling zone are generally not equal but the roll gap is smaller in a roll segment close to the mold, but the setting increases as the distant increases from the mold. Two or more segments differ in the roll gap are used in one continuous casting machine. Therefore, the above-mentioned periodical molten metal level fluctuations due to irregular bulging may contain not only one but also two or more frequency components as the case may be.

In addition, when a guide roll and/or pinch roll is eccentric, namely not straight, the slab in which the liquid core is involved is periodically subjected to a reduction and release, so that periodical molten metal level fluctuations occur in the mold. Generally, a plurality of guide rolls differing in diameter are used in one continuous casting machine and, therefore, the periodical molten metal level fluctuations due to the eccentricity of rolls may contain not only one but also two or more frequency components as the case may be.

In order to prevent the occurrence of periodical molten metal level fluctuations in the mold due to irregular bulging, a method which is disclosed in JP Kokai (Laid-open Unexamined Japanese Patent Application) H04-65742, which states that the roll gaps in the secondary cooling zone are made unequal.

FIG. 3 is a block diagram illustrating a system in the conventional use for controlling molten metal level fluctuations in continuous casting. The symbol 12 indicates a molten metal level controller, 15 a deflection calculation part calculating the difference between the set value of the molten metal level and the deflection, 16 a control logic part executing proportional position and integral motion operations, 17 the transfer function of a stopper driving device, 18 the transfer function of a stopper, 19 the transfer function of the mold, and 20 the transfer function of a molten metal level meter. In the same figure, SP is a molten metal level value (mm) as set, PV is a molten metal level value (mm) as measured by the molten metal level meter, and MV is an output (mm) of the molten metal level controller.

In JP Kokai H05-23811, there is disclosed a technique of preventing molten metal level fluctuations in the mold which comprises superimposing a sine signal for compensation on a control signal so that the molten metal level fluctuations in the mold may be eliminated, on the assumption that the periodical molten metal level fluctuations in the mold show a sine-shaped curve.

In JP Kokai H10-314911, there is disclosed a method of preventing periodical molten metal level fluctuations in the mold due to irregular bulging by providing, for advancing the phase of molten metal level deflections, a phase compensator which frequency characteristics are adjusted to the frequencies of the periodical molten metal level fluctuations in the mold, and by inputting the molten metal level deflections in this phase compensator and adding the output of this phase compensator to the operation output of the molten metal level controller, namely the control command to a sliding nozzle or stopper controller, for thereby compensating the phase delay due to the integral characteristics of the mold mass balance.

Among the technologies of suppressing the occurrence of periodical molten metal level fluctuations due to irregular bulging, the method disclosed in JP Kokai H04-65742 which comprises making unequal the roll gaps in the secondary cooling zone requires many kinds of spare roll segment, hence causes increases in cost of equipment.

When such a prior art control system as shown in FIG. 3 is used, the periodical molten metal level fluctuations may become a little greater in some instances. The reason is that the loop gain at a specific frequency of the feed back control system shown in FIG. 3 is greater than 1, so the control system becomes unstable.

According to the method of control, as disclosed in JP Kokai H05-23811, the periodical molten metal level fluctuations due to irregular bulging are assumed as one sinusoidal wave or ramp type fluctuations which increase or decrease at a constant inclination, and are assumed as fluctuations that depend on the roll gap and casting rate, hence the method cannot cope with a case in which the periodical molten metal level fluctuations include a plurality of frequency components.

According to the control method, disclosed in JP Kokai H10-314911, the frequency components of the periodical molten metal level fluctuations are input into the molten metal level controller and, therefore, the output of the molten metal level controller and the operation results of the phase compensator interfere with each other, hence the method cannot cope in the case where there are a plurality of frequencies of periodical molten metal level fluctuations.

DISCLOSURE OF INVENTION

It is an object of the present invention, which has been made in view of the above problems in the prior art, to provide a method of controlling the level of the molten metal in a mold, a control apparatus therefor and a method of continuous casting of steel which can cope with the respective frequencies and amplitudes of periodical molten metal level fluctuations due to irregular bulging and periodical molten metal level fluctuations due to the eccentricity of pinch rolls, and which, even when a plurality of frequencies of periodical molten metal level fluctuations exist, can cope with the plurality of frequencies and efficiently prevent the molten metal level fluctuations.

The gist of the present invention is as follows:

The method of control according to the invention is a method of controlling the level of the molten metal in a mold which comprises determining in advance the frequencies of periodical molten metal level fluctuations in the mold and damping selectively the predetermined frequency of frequencies of periodical molten metal level fluctuations through a notch filter installed in the control loop of the molten metal level controller. In this method of control, it is desirable that the notch filter for damping selectively the predetermined frequency and the phase compensation operation part for compensating the phase delay of the stopper opening position control signal which adjust the amount of the molten metal to be fed into the mold be involved in the control loop.

The control apparatus of the invention is a apparatus which comprises, in the control loop thereof, a molten metal level senser, an FFT analyzer, an automatic tune up device for the results from the FFT analyzer, a molten metal level controller and a notch-filter. It is desirable that this control apparatus further comprises a phase compensation calculation part consisting of a band pass filter, a phase compensator and a phase compensation gain calculation part.

The method of continuous casting of steel, according to the invention, is a method of casting a molten metal into slabs which are rectangular in shape, using the control method and the control apparatus mentioned above.

BEST MODES FOR CARRYING OUT THE INVENTION

The present inventors made simulations and carried out continuous steel casting tests concerning various molten metal level controllers and methods of control, using the controllers in an attempt to prevent periodical molten metal level fluctuations in the mold due to irregular slab bulging, the eccentricity of pinch rolls or other rolls, and obtained the following findings.

First, the characteristic features of these periodical molten metal level fluctuations are described below.

Figure 4:
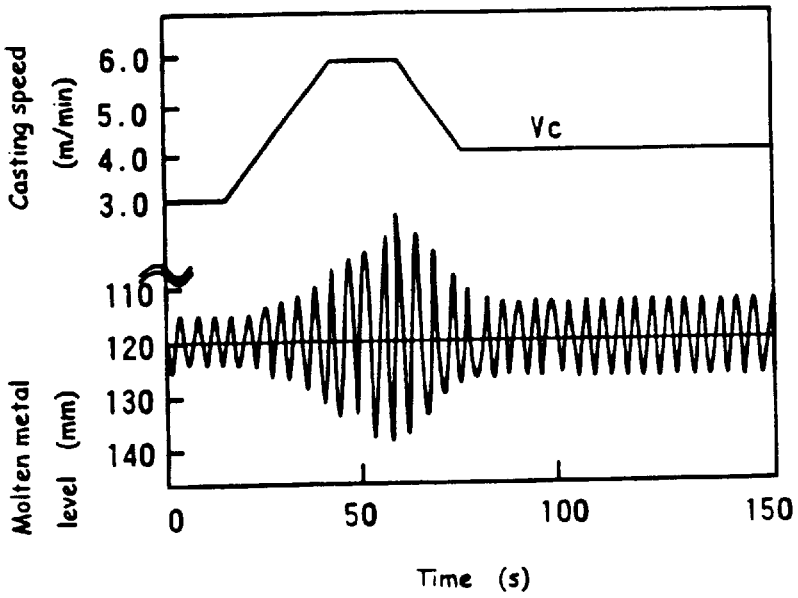
FIG. 4 is a graphic representation of molten metal level fluctuations upon occurrence of irregular bulging or roll eccentricity.

FIG. 4 schematically shows the molten metal level fluctuations upon occurrence of irregular bulging or roll eccentricity. As the casting speed Vc is increased, the periodical molten metal level fluctuations increase and, as the casting speed is decreased, the fluctuations become smaller. When the casting speed is high, the slab surface temperature is apt to become locally uneven or irregular and when the casting speed is changed, the slab surface temperature is apt to become irregular in the direction of casting. When the slab surface temperature become irregular, irregular bulging can occur easily, hence periodical molten metal level fluctuations tend to occur.

For example, in continuously casting slabs having a thickness of about 80 to 120 mm, the casting speed is 3 to 8 m/min. In a continuous casting machine for casting such slabs, the roll gaps in the secondary cooling zone are generally about 160 to 250 mm and the pinch roll diameter generally used is about 160 to 190 mm. Therefore, the frequencies of periodical molten metal level fluctuations tend to occur in the zone of 0.1 to 0.5 Hz.

Figure 5:
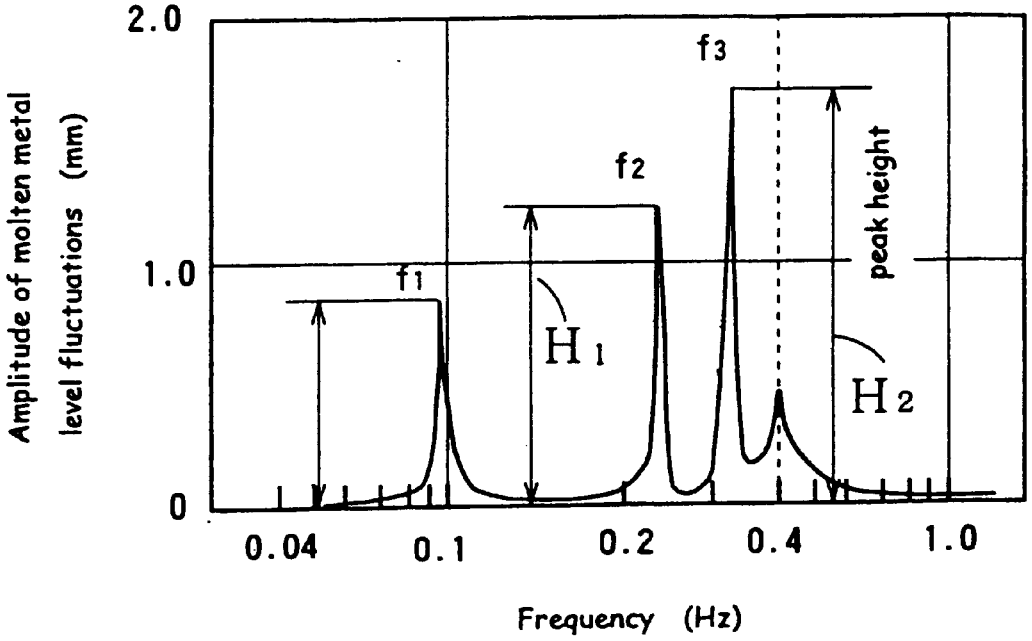
FIG. 5 is a frequency spectrum of molten metal level fluctuations.

FIG. 5 shows an example of the frequency spectrum of periodical molten metal level fluctuations. In this example, there are three frequency peaks, which are represented by $f_1$, $f_2$ and $f_3$ (Hz), and then the following relations (1) to (3) are found:

$$f_1 = Vc \times (1000/60)/2\pi R_{sc} \quad (1)$$

$$f_2 = Vc \times (1000/60)/d_1 \quad (2)$$

$$f_3 = Vc \times (1000/60)/d_2 \quad (3)$$

where Vc is the casting speed (m/s), $R_{sc}$ is the pinch roll radius (mm), $d_1$ is the secondary cooling zone roll gap (mm) just below the mold and $d_2$ is the roll gap (mm) far below the mold. For $d_1$ and $d_2$, see FIG. 1.

The fluctuations with the frequencies corresponding to $f_2$ and $f_3$ are periodical molten metal level fluctuations due to irregular slab bulging and the fluctuations with the low frequency which correspond to $f_1$ are periodical molten metal level fluctuations due to the eccentricity of guide rolls and pinch rolls.

Then, the problems of the prior art control system are described below.

Figure 3:
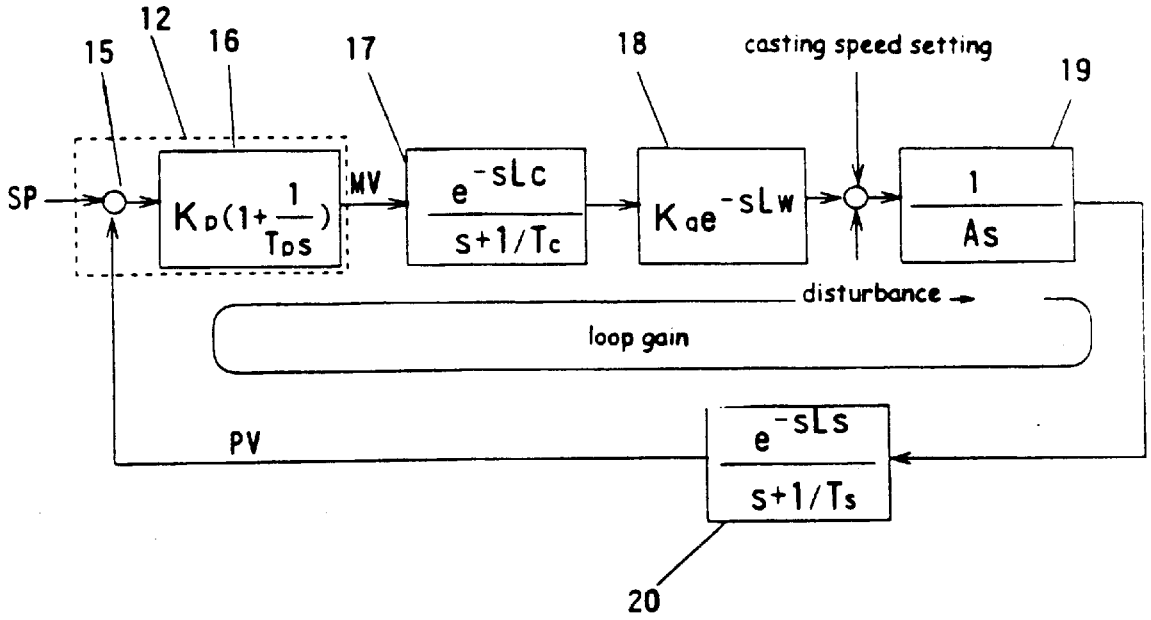
Fig. 3 PRIOR ART
FIG. 3 is a block diagram illustrating a prior art control system.
Figure 6:
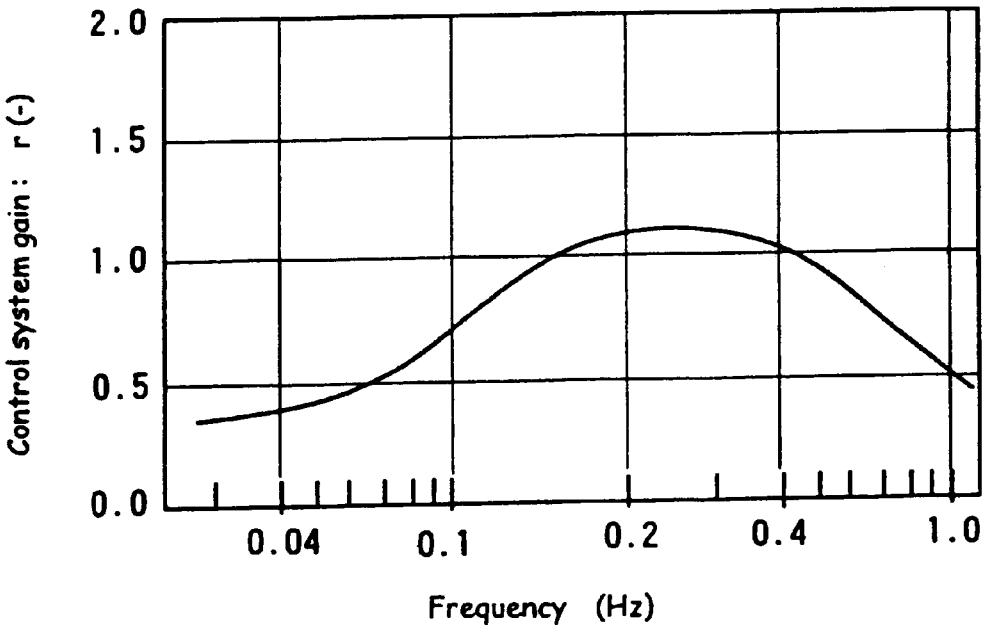
FIG. 6 is a graphic representation of the control system gain of the control system shown in FIG. 3, namely the magnitude of disturbance input-responding molten metal level fluctuations, versus the frequency.

FIG. 6 is a graphic representation of the control system gain of the control system shown in FIG. 3 and in conventional use, namely the magnitude of molten metal level fluctuations when the disturbance is input, versus the frequency of the fluctuations. The ordinate denotes the gain r of the control system, namely the ratio or quotient of the amplitude of molten metal level fluctuations divided by the amplitude of disturbance input. In the range where the control system gain r is in excess of 1.0, it is indicated that the molten metal level fluctuations are amplified in response to the disturbance in that frequency range and superimposed on the disturbance input, with the result that the amplitude of the molten metal level fluctuations further increases. The reason why the molten metal level fluctuations become a little greater when feedback control is performed in such a control system is that the control system undergoes sympathetic vibration at frequencies of periodic molten metal level fluctuations, in particular at frequencies resulting from irregular bulging.

In the following, the constitution of the present invention is described below in detail. The molten metal level controlling method, control apparatus and continuous casting method of this invention are described collectively.

First, in the control method and control apparatus of the invention, in controlling the level of the molten metal in a mold for continuous casting using a molten metal level controller, the frequencies of periodical molten metal level fluctuations are determined beforehand using an FFT analyzer and an automatic tune up device thereof, and also a notch filter, for damping selectively the predetermined frequencies, is incorporated in the control loop of the molten metal level control system.

By incorporating the notch filter in the control system loop, it becomes possible to cut off or reduce the loop gain to thereby suppress the occurrence of periodical molten metal level fluctuations.

As the notch filter for producing such effects, either a plurality of notch filters which is equal in number to the frequencies of periodical molten metal level fluctuations and connected in series, or one single notch filter which is capable of damping the frequency components over a specific range covering several frequencies may be selected.

Secondly, in the control method and control apparatus of this invention, in controlling the level of the molten metal in the mold for continuous casting using a molten metal level controller, the frequencies of periodical molten metal level fluctuations are determined beforehand using an FFT analyzer and an automatic tune up device thereof. A notch filter for damping selectively the predetermined frequencies is incorporated in the control loop of the molten metal level control system. Further, a phase compensation calculation part is constituted by a connection in series of a band pass filter, adjusted so as to selectively transmit the fluctuation components of specific band pass frequencies including the above-mentioned frequencies determined beforehand, and a phase compensator, adjusted so that the phase compensation frequencies may include the above-mentioned frequencies determined beforehand, and a phase compensation gain calculation part for outputting the product of an input signal and the phase compensation gain. And the phase compensation operation part is incorporated in the control loop. Furthermore, the molten metal level deflections are input in the phase compensation calculation part and the output of this phase compensation calculation part is added to the operation output of the molten metal level controller.

The method comprising incorporating a notch filter alone in the control loop of the molten metal level control system can suppress the occurrence of the periodical molten metal level fluctuations, as mentioned above. And the level fluctuations of the frequency components will not be increased or diverge. However, when the feeding of molten steel to the mold is controlled and thereafter the molten metal level in the mold is adjusted, the integral components occurring in the system cause a phase delay of 90°. Therefore, cutting off the periodical molten metal level fluctuations from the control system by a notch filter only indeed results in a decrease in the periodical molten metal level fluctuations, due to irregular bulging proper, so further improvements are demanded.

A method of solving this problem is incorporating a phase compensation calculation part in the control loop to thereby compensate the phase delay of the position control signal which controls the stopper opening for adjusting the rate of feeding molten steel to the mold, and thus this prevents the occurrence of periodical molten metal level fluctuations. This phase compensation calculation part is constituted of a band pass filter, a phase compensator and a phase compensator gain calculation part, and the band pass filter discriminates the frequency components of the periodical molten metal level fluctuations, and the phase compensator performs operational treatment for phase advancement and the phase compensator gain calculation part multiplies the input signal by the phase compensation gain and outputs the signal.

The phase compensation calculation part is incorporated in parallel with the notch filter incorporated in the control loop. This is for the purpose of reducing the loop gain of the control system in response to the frequencies of the periodical molten metal level fluctuations by means of the notch filter, discriminating those frequency components only by the band pass filter and, after phase compensation, adding the phase compensated frequency components to the output of the molten metal level controller.

Thirdly, in the control method and control apparatus of the invention, in order to determine the frequencies of periodical molten metal level fluctuations beforehand, an FFT analyzer and an automatic tune up device are incorporated in the control loop.

The frequencies and amplitudes of periodical molten metal level fluctuations, due to irregular bulging, and of periodical molten metal level fluctuations, due to roll eccentricity, do not always remain constant during casting. Therefore, any of the notch filter characteristics, namely the notch frequencies or notch filter ratios, the band pass filter characteristics, namely the band pass frequencies, and the molten metal level controller gain cannot be fixed at a constant level.

Therefore, it is desirable to incorporate an FFT analyzer and an automatic tune up device within the molten metal level control loop to thereby always measure the periodical molten metal level fluctuations, analyze the frequencies thereof and ascertain the peak frequency components and the amplitudes of the periodical molten metal level fluctuations. Then, it becomes possible to automatically set up the characteristic parameters of the notch filter and band pass filter to thereby suppress the periodical molten metal level fluctuations changing with time.

Fourthly, in the control method and control device of the invention, in order to control the level of the molten metal in the mold for continuous casting, using a molten melt level controller, a variable frequency oscillator is incorporated in the control loop of the molten metal level control system and, in order to determine the frequencies of periodical molten melt level fluctuations beforehand, this oscillation frequency is tuned to a frequency of the molten metal level fluctuations and, using such a control system, the frequency of molten metal level fluctuations is determined based on the oscillation frequency which is determined by tuning.

In the FFT analysis, namely frequency analysis by Fast Fourier Transformation, it is in principle necessary to sample measured data on molten metal level fluctuations over a period of about 50 seconds. Therefore, the molten metal level control can be started only after at least 50 seconds from the start of measurements. In cases where the frequency changes are moderate, the periodical molten metal level fluctuations can be suppressed by this method. However, it is presumable that when new periodical molten level fluctuations occur as a result of a change in casting speed or slab cooling conditions, the responses of the molten metal level control system may be delayed to some extent.

Therefore, for further shortening the response time of the molten metal level control, the control method which comprises incorporating a variable frequency oscillator in the control loop of the molten metal level control system is used. According to this method, the frequencies of the periodical molten metal level fluctuations are determined by causing the oscillation frequencies of the variable frequency oscillator to coincide with the frequencies of the periodical molten metal level fluctuations. By this method, the frequencies of periodical molten metal level fluctuations can be determined more quickly and the response time of the molten metal level control can be further shortened.

Next, concrete control methods in which the above-mentioned first to fourth features are embodied are described.

First a concrete method of control, a method of control which comprises incorporating a notch filter in the control loop is described below.

Figure 7:
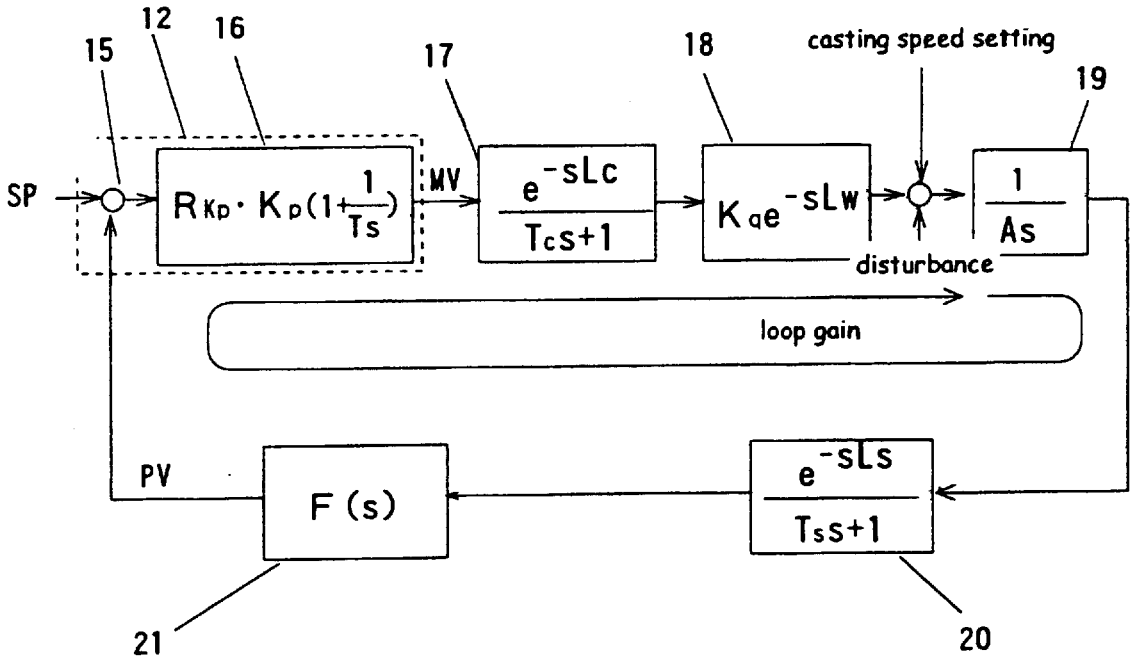
FIG. 7 is a block diagram of an example of the control system according to the invention.

FIG. 7 is a block diagram for illustrating an example of the method of control and of the control apparatus according to the invention. The control loop is constituted of a control logic part 16, the transfer function 17 of a stopper driving device, the transfer function 18 of a stopper, the transfer function 19 of the mold, the transfer function 20 of a molten metal level meter and a notch filter 21. The loop gain is invariable, irrespective of the part of the incorporation of the notch filter 21, so the constitution shown in FIG. 7 has the notch filter 21 incorporated in the line of the molten metal level PV. The symbol 12 indicates a molten metal level controller, 15 a deflection calculation part calculating the difference between a molten metal level value as set and the deflection, SP the molten metal level value (mm) as set, PV the molten metal level value (mm) as measured by the molten metal level meter, and MV an output value (mm) of the molten metal level controller.

Figure 8:
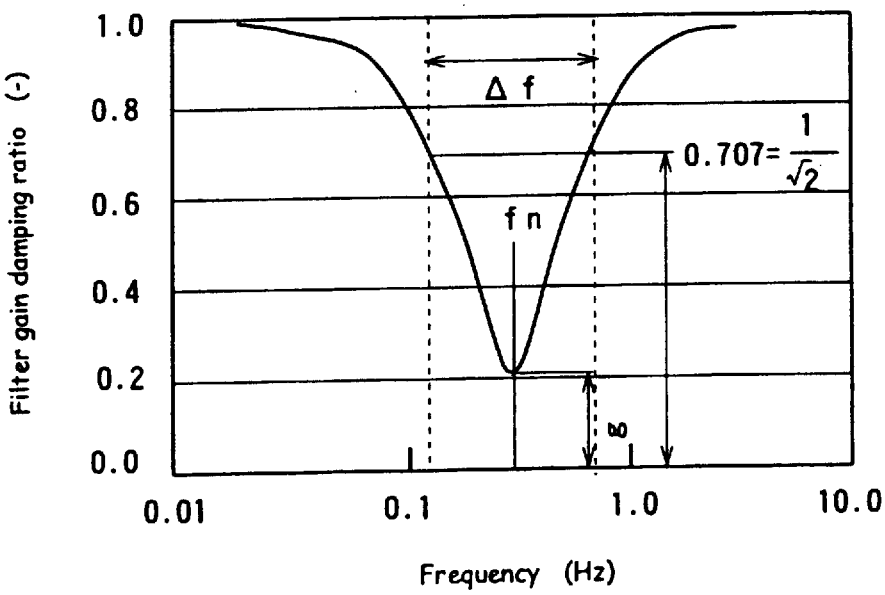
FIG. 8 is a graphic representation of the filter gain of the notch-filter shown in FIG. 7.

FIG. 8 is a graph showing the filter gain of the notch filter shown in FIG. 7. The transfer function F(s) of the notch filter is represented by the formula (4), wherein ω represents the angular frequency and $\omega=2\pi f$.

$$F(s) = \frac{s^2 + 2Qg\omega s + \omega^2}{s^2 + 2Qg\omega s + \omega^2} \tag{4}$$

In FIG. 8, the filter gain, namely the damping ratio which is the ratio of the output to the input (output divided by input) is lowest at the notch frequency $f_n$ and the damping ratio at that time is g, namely the notch filter ratio. The band coefficient Q is the value indicating the sharpness of the trough-like shape in FIG. 8 and is defined as the ratio of the frequency band width Δf to $f_n$ at the time when the damping ratio becomes $(0.5)^{1/2}=0.707$; the greater Q is, the narrower the width of the trough is and the sharper the shape of the trough is. When the notch frequency $f_n$ of the notch filter is adjusted to the frequency f of periodical molten metal level fluctuations, the amplitude thereof is suppressed and therefore the amplitude can be inhibited from increasing by means of the control system even when periodical molten metal level fluctuations occur. Even when the notch frequency $f_n$ is not in perfect agreement with the frequency f of periodical molten metal level fluctuations, the same effects are produced if this f is within the range of the frequency width Δf of the notch filter.

Figure 9:
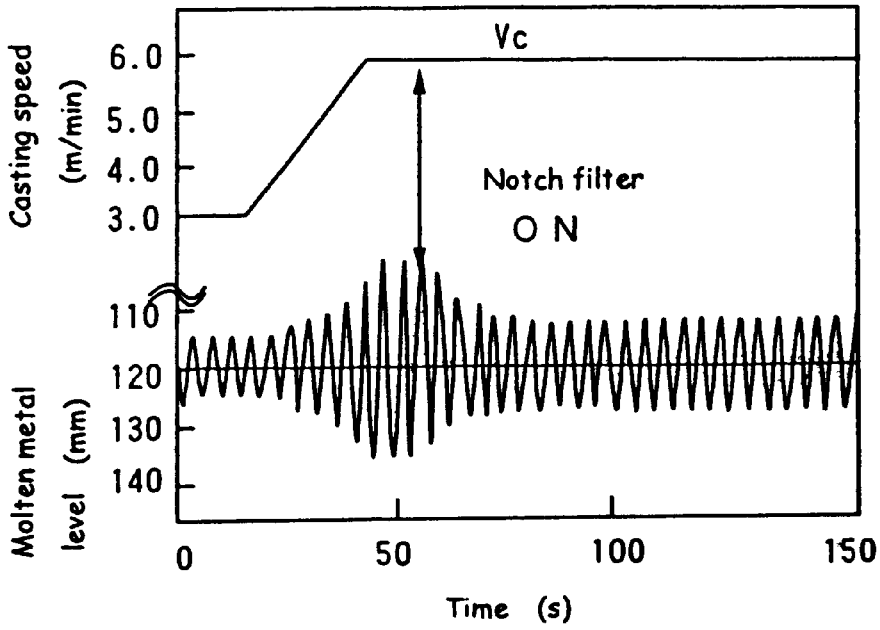
FIG. 9 is a graphic representation of the molten metal level fluctuations as simulated by the control system shown in FIG. 7.

FIG. 9 shows the molten metal level fluctuations as obtained by performing a simulation using the control system block diagram shown in FIG. 7. The notch frequency of the notch filter was made to coincide with a frequency of periodical molten metal level fluctuations and the gain of the molten metal level controller was thereby adjusted. Comparison of FIG. 9 with the above-mentioned FIG. 4 reveals that whereas, in FIG. 4, the molten metal level fluctuations show a continuously increasing tendency when the casting speed rises to 6 m/min, the amplitude at the casting speed Vc of 6 m/min in FIG. 9 does not show any continuously increasing tendency, though the amplitude at that time is greater than that at the casting speed of 3 m/min, and thus the casting speed need not be slowed down.

As mentioned above referring to FIG. 5, when there are a plurality of frequencies of periodical molten metal level fluctuations, a plurality of notch filters, corresponding to the respective frequencies, can be incorporated in series in the control loop. In reality, it is rare that the frequencies are remote from one another. Inmost cases, the frequencies are close to one another, even when two or three or more roll gaps are found.

In those cases, the present invention can be realized by incorporating, in the control loop, one notch filter capable of damping the frequency components over a band covering the range of these frequencies of periodical molten metal level fluctuations. Namely, it is only required that the band width Δf of the notch filter shown above in FIG. 8 be enlarged.

How to select and set the notch frequency f of the notch filter, the notch filter ratio g, the band coefficient Q and the proportional gain of the molten metal level controller $K_p$ is now described below.

Here, an example is described in which molten metal level fluctuations with the frequencies $f_2$ and $f_3$, which are in the relation $f_2<f_3$, among the frequencies of periodical molten metal level fluctuations as mentioned above referring to FIG. 5, are suppressed. In this example, the molten metal level fluctuations with the frequencies $f_2$ and $f_3$ are due to irregular bulging. The frequency $f_1$, which is lower than 0.1 Hz, is, in many cases, a low frequency peak due to pinch roll eccentricity, for instance, and it is not necessary to damp this frequency using a notch filter, since this case can be coped with by increasing the proportional gain of the molten metal level controller.

Figure 10:
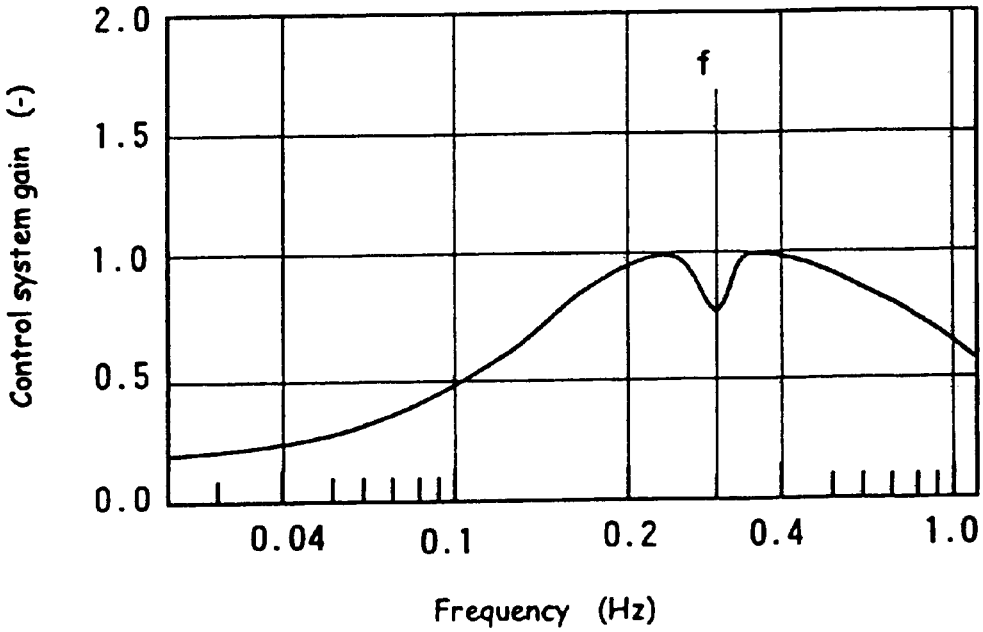
FIG. 10 is a graphic representation of the control system gain in carrying out control by using a notch filter capable of damping the frequency components over a band covering the range of frequencies $f_2$ to $f_3$.

FIG. 10 shows the control system gain achieved when a notch filter having damping characteristics in the frequency band covering the range from the frequency $f_2$ to $f_3$ of molten metal level fluctuations due to irregular bulging is incorporated in the control loop.

Figure 11:
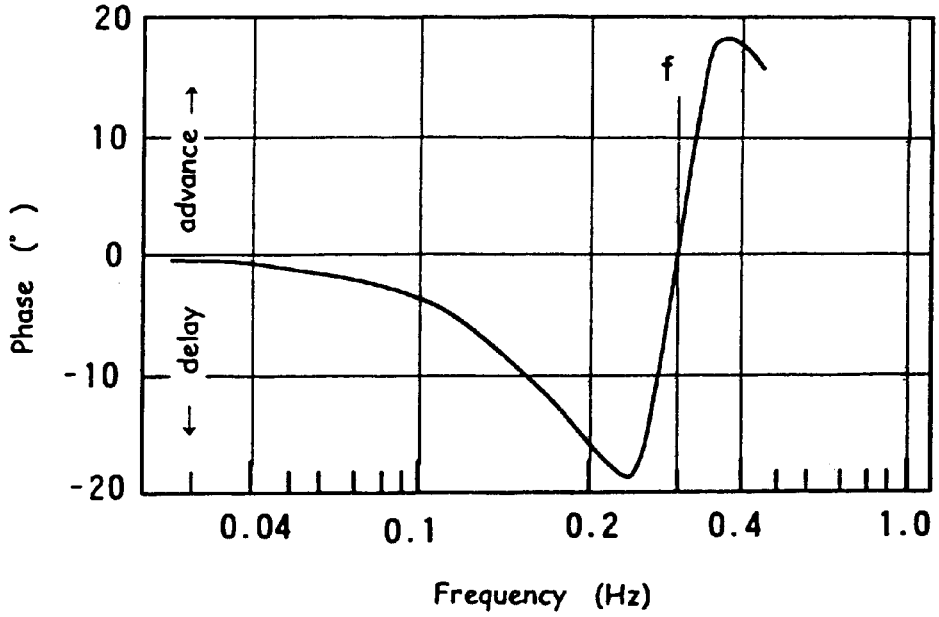
FIG. 11 is a graphic representation of the phase of the control system corresponding to the control system gain shown in FIG. 10.

FIG. 11 shows the phase of the control system corresponding to the control system gain shown in FIG. 10.

First, the band coefficient Q is determined after considering the balance between the band width of the notch filter and the phase delay in the low frequency range of not more than 0.1 Hz. When the cut off frequency of the control system, namely the notch frequency f shown in FIG. 10, is 0.2 to 0.5 Hz, Q is set at about 5 to 10 so that the phase delay shown in FIG. 11 may be not more than 18°.

Then, the notch filter ratio g and the proportional gain $K_p$ are determined, for example, in the following manner.

As mentioned above referring to FIG. 5, the amplitude values of molten metal level fluctuations at the frequencies $f_2$ and $f_3$, which are in the relation $f_2<f_3$, are represented by $H_1$ and $H_2$ and the notch filter parameter g and the proportional gain $K_p$ in the control logic part are determined based on the relation in magnitude between $H_1$ and $H_2$. This way of thinking is based on the policy of placing greater importance on the molten metal level fluctuations showing a greater amplitude when there are two kinds, which differ in frequency of the molten metal level fluctuations due to irregular bulging. In this case, a reference value $H_{10}$ for the amplitude $H_1$ and a reference value $H_{20}$ for the amplitude $H_2$ of molten metal level fluctuations are determined beforehand in order to judge the magnitudes of the amplitudes $H_1$ and $H_2$ of molten metal level fluctuations. $H_{10}$ and $H_{20}$ are set at values of 1 to 3 mm and these values are allowable as ordinary molten metal level fluctuations.

Then, by frequency analysis of the periodical molten metal level fluctuations, the peak heights $H_1$ and $H_2$ of the fluctuations are actually measured and judgments are made about the conditions $H_1>H_{10}$ and $H_2>H_{20}$. The results of judgement about these conditions are divided into the following four cases:

$$H_1 \leqq H_{10} \text{ and } H_2 \leqq H_{20} \qquad \text{Case (I):}$$

In this case, both the fluctuations at the lower frequency and those at the higher frequency are within the tolerance limits. In this case, the control is in good condition and no change is made in proportional gain $K_p$.

$$H_1>H_{10} \text{ and } H_2 \leqq H_{20} \qquad \text{Case (II):}$$

In this case, the fluctuations at the lower frequency $f_2$ are greater and the fluctuations at the higher frequency $f_3$ are smaller. In this case, the notch filter ratio g is maintained as it is and for increasing the stability relative to $f_2$, $K_p$ is increased.

Here, the adjustment coefficient $R_{kp}$ for $K_p$ is explained. A reference value for the proportional gain $K_p$ of the molten metal level controller is represented by $K_{p0}$, and the value derived from this $K_{p0}$, by multiplying by $R_{kp}$, is employed as the proportional gain $K_p$ for actual use. A value resulting from adjustment using a grade of low carbon steel is used as the reference proportional gain value $K_{p0}$, because, when a grade of low carbon steel is cast, irregular bulging hardly occurs and casting is possible. This $K_{p0}$ is multiplied by a $R_{kp}$ value which is generally not more than 1.

$$H_1 \leqq H_{10} \text{ and } H_2>H_{20} \qquad \text{Case (III):}$$

In this case, the fluctuations at the higher frequency $f_3$ are great and the fluctuations at the lower frequency $f_2$ are small. In this case, the notch filter ratio g is decreased and, for increasing the stability at $f_3$, the proportional gain $K_p$ is also decreased within the range in which the fluctuations at $f_2$ will not increase.

$$H_1>H_{10} \text{ and } H_2>H_{20} \qquad \text{Case (IV):}$$

In this case, the fluctuations are great at either of the frequencies. At the higher frequency $f_3$, there is the possibility of mold powder trapping and, therefore, it is desirable that the notch filter ratio g and proportional gain $K_p$ be decreased. However, an excessive reduction of $K_p$ may allow increased fluctuations on the $f_2$ side, possibly causing the phenomenon of the solidification becoming not even due to powder sintering, namely there arises the possibility of breakout due to the phenomenon of formation of powder bearing portions. In this case, the notch filter ratio g is decreased to the same small value as employed in the case (III) and the proportional gain adjusting coefficient $R_{kp}$ is determined by a proportional division-based calculation from the adjustment coefficients as in the cases (II) and (III), as follows:

$$R_{IV}=\alpha R_{III}+\beta R_{II}$$

where $\alpha+\beta=1$, $0<\alpha<1$ and $0<\beta<1$.

Figure 12:
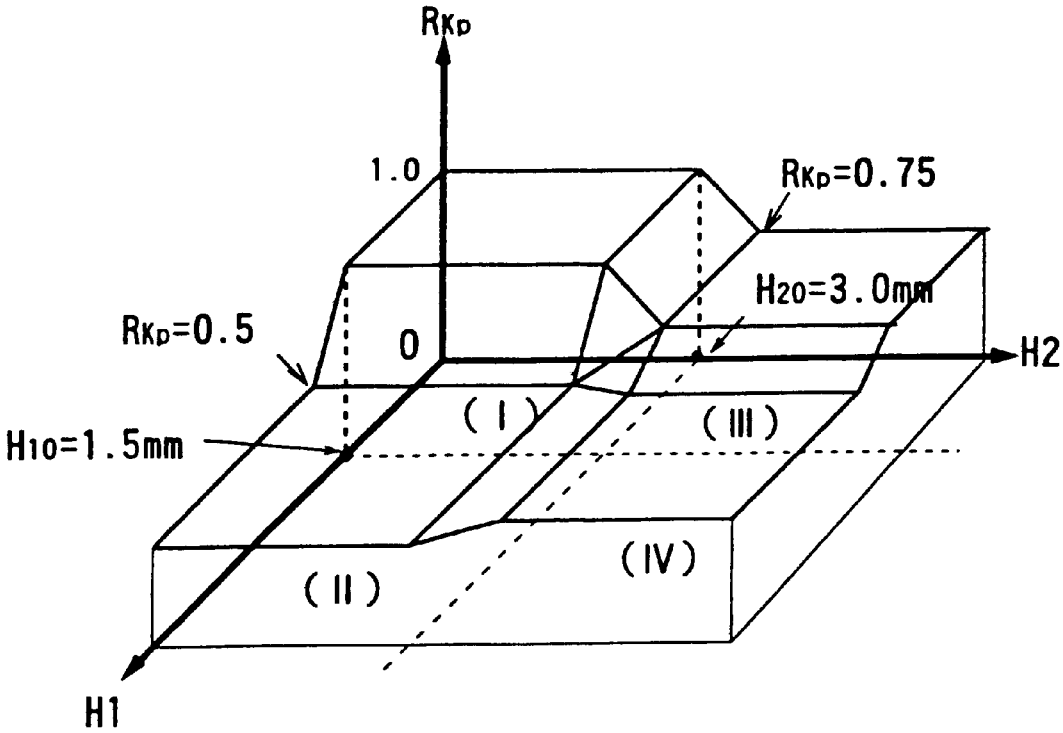
FIG. 12 is a schematic representation of a method of setting the adjustment coefficient $R_{kp}$ for multiplying the proportional gain $K_p$ thereby.

FIG. 12 is a schematic representation of an example of the method of setting the adjustment coefficient $R_{kp}$ to be used in multiplying the proportional gain $K_p$. The domains indicated by (I), (II), (III) and (IV) on the $H_1$–$H_2$ plane correspond to cases (I), (II), (III) and (IV), respectively. The value of each $R_{kp}$ is indicated by the height of the plateau of each domain. The height $R_I$ of the plateau of domain (I) is highest and is equal to 1. $R_{II}$ and $R_{III}$ of the $R_{kp}$ values in domains (II) and (III) are smaller, and $R_{IV}$ of the $R_{kp}$ values in domain (IV) is represented by a height calculated from the heights in domains (II) and (III) on the proportional division basis.

The slope-like course of change of $R_{kp}$ between domains (I) and (II) along the $H_1$ axis is intended for preventing rapid changes of $R_{kp}$ (or of the proportional gain of the control logic part) around the borderline $H_{10}$ or $H_{20}$, and the width of slope is 0.5 to 1 mm on the $H_1$ axis. The same applies to the slope between domain (I) and domain (III) and the slope from domain (II) or (III) to domain (IV) along the $H_2$ axis. The height of domain (I) is 1.0, and the heights of domains (II), (III) and (IV) are determined beforehand as reference values, namely $R_{II}$ to $R_{IV}$.

Figure 13:
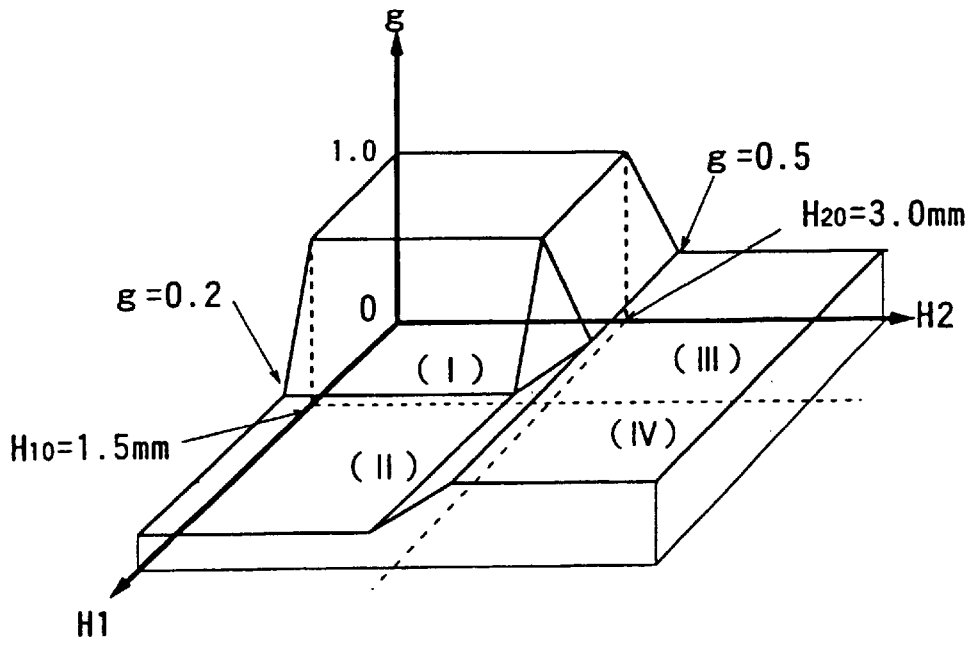
FIG. 13 is a schematic representation of a method of setting the notch filter ratio g.

FIG. 13 is a schematic view illustrating the method of adjusting the notch filter ratio g. The same technique as used in setting $K_p$ can be used for g as well. As in FIG. 12, the domains indicated by (I), (II), (III) and (IV) on the $H_1$–$H_2$ plane correspond to the above cases 1, 2, 3 and 4, respectively. In domain (I), the control is in a stable condition, hence the notch filter ratio $g=g_1=1.0$ and, thus, there is no damping by the notch filter and the characteristics are flat, without any trough-like falling, as mentioned above in relation to FIG. 8.

In domain (II) in FIG. 13, $g=g_{II}=0.2$, for instance. In FIG. 8 referred to above, the bottom of the trough at the frequency f of the notch filter is at a height of 0.2 and, thus, the notch filter damps 80 percent of the amplitude of the feedback signal at the frequency f. The values of g in domains (II) to (IV), namely $g_{II}$ to $g_{IV}$, are predetermined in the same manner as in the case of $R_{kp}$.

The above-mentioned notch filter parameters, namely the notch frequency f, notch filter ratio g and band coefficient Q, are set during casting. This is because the place of occurrence of irregular bulging shifts to the upstream side or downstream side in the secondary cooling zone according to the casting conditions and the roll gap differs from place to place, so that the frequency of molten metal level fluctuations, due to irregular bulging, varies. Therefore, the notch filter parameters f, g and Q are calculated on the real time basis so that the cut off frequency of the notch filter may always be set at an optimum level. For carrying out this automatic calculation, an FFT analyzer and automatic tune up part are provided in the control loop.

As a result of FFT analysis, such a frequency spectrum as shown in FIG. 5 mentioned above is obtained for molten metal level fluctuations. In the automatic tune up part, the frequencies $f_2$ and $f_3$ and peak heights thereof $H_1$ and $H_2$ are calculated based on the results of the above FFT analysis, and the notch filter parameters f, g, Q and the proportional gain $K_p$ of the control logic part are automatically set.

In the above description, a method of automatically setting up the notch filter parameters f, g, Q and the proportional gain $K_p$ of the control logic part while selecting $f_2$ and $f_3$ as the frequencies of periodical molten metal level fluctuations, due to irregular bulging, has been explained. As a premise, it was supposed that the peak frequency $f_1$ found in a frequency range less than 0.1 Hz as shown in FIG. 5 can be regarded as resulting from molten metal level fluctuations due to the eccentricity of pinch rolls and other rolls, and this frequency resulting from molten metal level fluctuations due to roll eccentricity can be suppressed by increasing the proportional gain of the molten metal level controller, since the frequency is a low frequency which is remote from the irregular bulging-associated frequencies. In certain instances, however, molten metal level fluctuations with a small amplitude may occur in spite of the fact that the frequency of the molten metal level fluctuations is less than 0.1 Hz. In such cases, the periodical molten metal level fluctuations due to irregular bulging can be coped with according to the present invention by the method mentioned below.

First, the molten metal level fluctuations are analyzed by the FFT technique on a real time basis and, when the maximum amplitude represented by $H_1$ as found in the frequency range below 0.1 Hz and the maximum amplitude $H_2$ of molten metal level fluctuations in the frequency band at 0.1 Hz and above are in the relation $H_1>0.7\ H_2$, namely when the molten metal level fluctuations in the low frequency band have an amplitude so large that they are not negligible as compared with the molten metal level fluctuations due to irregular bulging, a notch filter for a band covering these two frequencies $f_1$ and $f_2$ is employed. The setting of the parameters f, g and Q of this notch filter and the proportional gain $K_p$ of the controller can performed in the same manner as mentioned above.

As a second concrete method of control, a control method comprising incorporating a notch filter and a phase compensation operation part in the control loop is described below.

Figure 14:
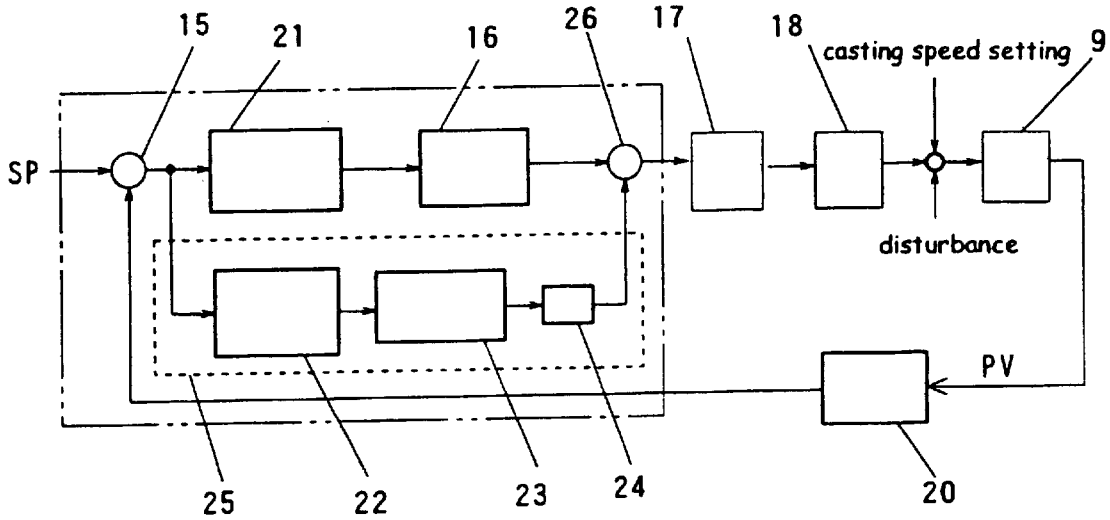
FIG. 14 is a block diagram illustrating the method of the invention.

FIG. 14 is a block diagram showing such method of control according to the present invention. The symbol 22 indicates a band pass filter, 23 a phase compensator, and 24 a phase compensation gain calculation part having a phase compensation gain $K_g$. The band pass filter 22, phase compensator 23 and phase compensation gain calculation part 24 are collectively enclosed by a broken line and collectively referred to as "phase compensation operation part 25". The molten metal level fluctuations are input to the phase compensation operation part 25 and the output of the operation results is added to the output of the control logic part 16 in an output addition part 26, and then a command value is given to the transfer function 17 of a stopper driving device. While, in FIG. 14, a notch filter 21 is inserted between a fluctuation calculation part 15 of the control system, which calculates the molten metal level fluctuations, and the control logic part 16, the same effects are produced irrespective of the place of insertion thereof in the control loop. The symbol 18 indicates the transfer function of stopper, the symbol 19 the transfer function of mold, the symbol SP indicates the molten metal level value (mm) as set, and PV is the molten metal level value (mm) as measured by a molten metal level meter.

Figure 15:
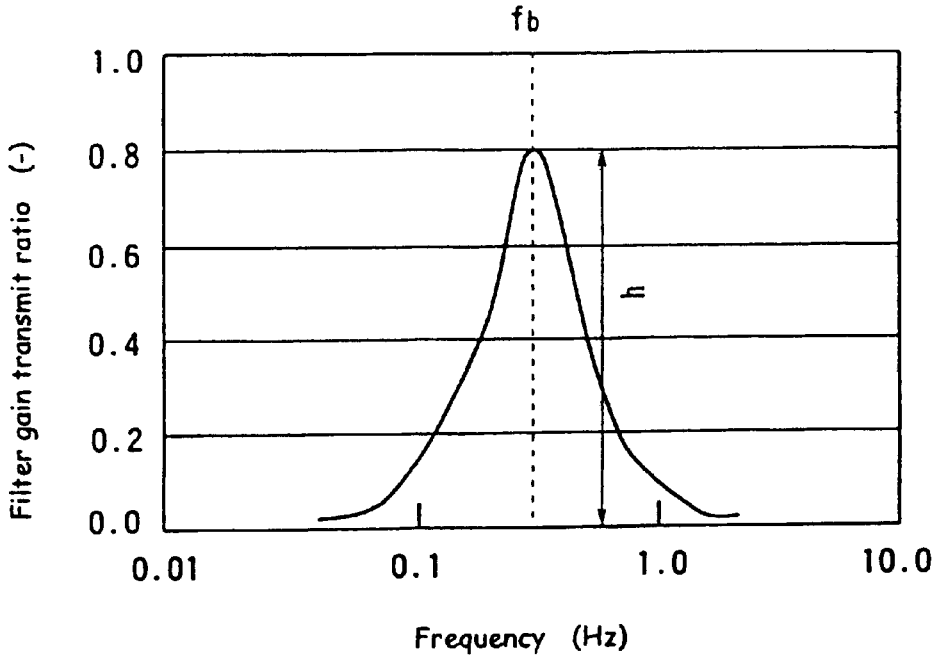
FIG. 15 is a graphic representation of the relation between the frequency of the band pass filter and the gain thereof, namely the transmit ratio.

FIG. 15 is a graphic representation of the relation between the frequency of the band pass filter and the gain (transmit ratio) thereof. At the band pass frequency $f_b$, the transmit ratio becomes maximum. The transmit ratio value on that occasion is referred to as "band pass ratio h". The band pass frequency $f_b$ is adjusted to the frequency f of periodical molten metal level fluctuations. The transfer function of the band pass filter is as shown by the formula (5) given below, wherein $\omega=2\pi f_b$ and when the band pass frequency $f_b$ is adjusted to the frequency f of periodical molten metal level fluctuations, $\omega=2\pi f$.

$$F(s) = \frac{2Qh\omega s}{s^2 + 2Qh\omega s + \omega^2} \tag{5}$$

Figure 16:
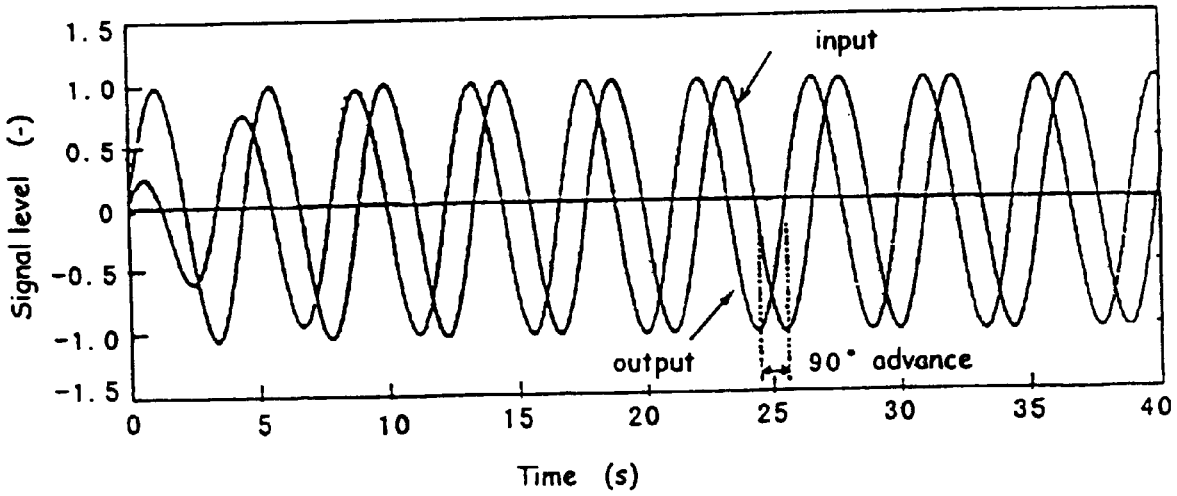
FIG. 16 is a graphic representation of the relation between the input and output of the phase compensator.

FIG. 16 is a graphic representation of the relation between the phase compensator input and output. The phase of the output advances by 90° as compared with the input signal to the phase compensator. Thus, the phase compensation is equivalent to performing a differential calculation. The transfer function of the phase compensator is shown by the formula (6) given below. Here, it is supposed that ω, namely the phase compensator frequency, is set at the same value as the frequency ω of periodical molten metal level fluctuations.

$$F(s) = \frac{s^2}{s^2 + 2Qh\omega s + \omega^2} \tag{6}$$

the phase compensation gain calculation part is a part for adjusting the amplitude of a signal that has passed through the band pass filter and phase compensator. Thus, it multiplies the input signal by the phase compensation gain $K_g$. When, as mentioned above referring to FIG. 14, the phase compensation operation part 25 is constituted of the band pass filter 22, phase compensator 23 and phase compensation gain calculation part 24 as connected in series, the phase of the specific frequency $f_b$ only can be allowed to advance. Since the phase compensation operation part 25 advances the phase by 90°, a control stabilizing effect is produced without increasing the amplitude of periodical molten metal level fluctuations.

Figure 17:
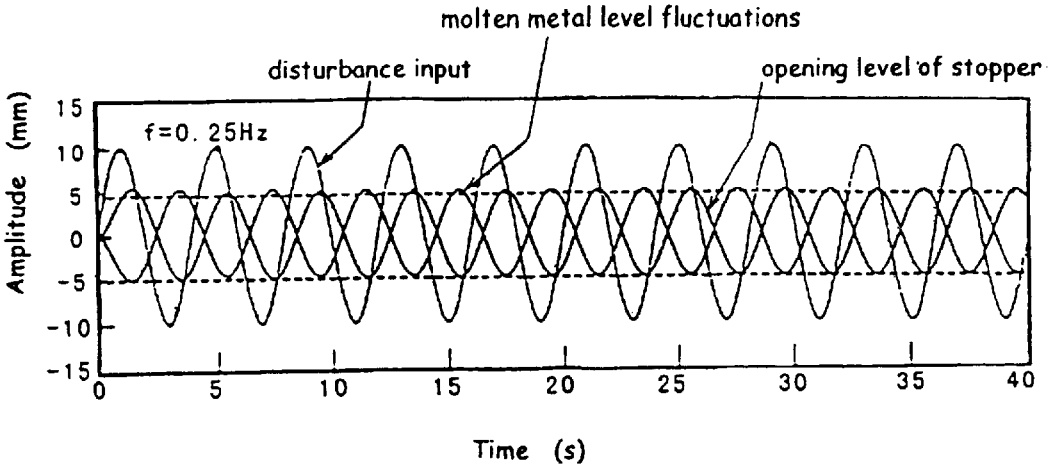
FIG. 17 is a graphic representation of the results of control simulation by the control system of the invention shown in FIG. 7.

FIG. 17 is a graphic representation of the results of simulation of the molten metal level fluctuations controlled by the control system according to the invention mentioned above referring to FIG. 7. There is shown a case in which molten steel volume fluctuations corresponding to a frequency of 0.25 Hz and an amplitude of ±10 mm are applied as the molten metal level fluctuations due to irregular bulging. By the control according to the invention, the disturbances consisting in volume fluctuations are not directly reflected on the molten metal level fluctuations but the molten metal level fluctuations are suppressed, with the amplitude of the fluctuations remaining within the range of ±5 mm.

Figure 18:
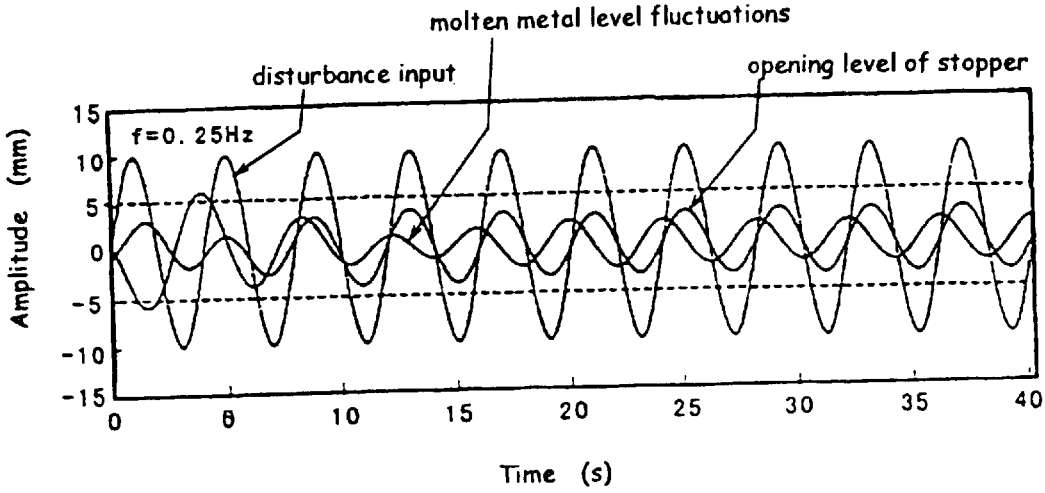
FIG. 18 is a graphic representation of the results of control simulation by the control system of the invention shown in FIG. 14.

FIG. 18 is a graphic representation of the results of simulation of the molten metal level fluctuations controlled by the control system according to the invention mentioned above referring to FIG. 14. Like in the above case of FIG. 17, there is shown a case in which molten steel volume fluctuations corresponding to a frequency of 0.25 Hz and an amplitude of ±10 mm are applied as the molten metal level fluctuations due to irregular bulging. As compared with FIG. 17, the molten metal level fluctuations can be more effectively suppressed and the amplitude of molten metal level fluctuations remains in the range of ±2.5 mm.

For the case of incorporating a notch filter and phase compensation operation part in the control loop, a method of automatic adjustment of the notch frequency f of the notch filter and the band pass frequency $f_b$ of the band pass filter is described below.

The frequency of periodical molten metal level fluctuations varies when the casting speed varies. Therefore, the frequency of molten metal level fluctuations is analyzed on line during casting for automatically adjusting the notch frequency f of the notch filter and the band pass frequency $f_b$ of the band pass filter.

Figure 19:
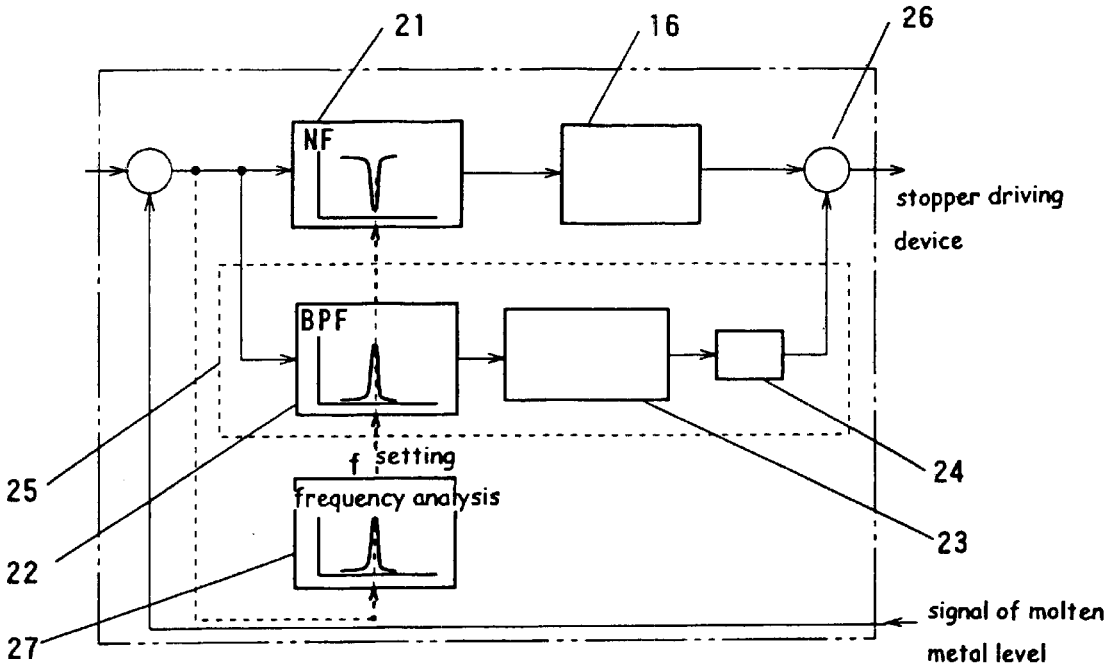
FIG. 19 is a block diagram illustrating the control method for automatic adjustment of the notch frequency and band pass frequency according to the invention.

FIG. 19 is a block diagram illustrating the control method for automatically adjusting the notch frequency and band pass frequency. FIG. 19 shows a part of the block of FIG. 14 which is enclosed by a chain double-dashed line, namely the block including the notch filter 21, control logic part 16 and phase compensation operation part 25, with the transfer function 17 of stopper drive device, the transfer function 18 of stopper, the transfer function 19 of the mold and the transfer function 20 of molten metal level meter being omitted in this figure.

Referring to FIG. 19, the frequency analysis part 27 is a device for frequency analysis of molten metal level fluctuations and for detecting the amplitudes of the respective frequencies, and also the FFT analyzer can be used. The frequency analysis part 27 detects the peak frequency of molten metal level fluctuations and regards the frequency as the frequency of periodical molten metal level fluctuations and automatically sets the notch frequency of the notch filter 21 and the band pass frequency of the band pass filter 22. In FIG. 19, the dotted line arrow from the frequency analysis part to the notch filter 21 and band pass filter 22 means the automatic frequency setting. As for the other symbols, 16 indicates a control side part, 23 a phase compensator, 24 a phase compensation gain calculation part with a phase compensation gain of $K_g$, 25 a phase compensation calculation part, 26 an output addition part, NF the notch filter, and BPF the band pass filter.

Since the frequency of the periodical molten metal level fluctuations is generally within the range of 0.1 to 0.5 Hz, the automatic frequency setting automatically for the notch filter and band pass filter is concerned only with the peak frequency among frequencies of not less than 0.1 Hz. Even if components of a frequency of 0 Hz which correspond to the mean value of the molten metal level are present, they can be neglected by performing frequency analysis operations by the double length precision method or performing frequency analysis operations using deflections of molten metal level fluctuations. In the case shown in FIG. 19, molten metal level deflections are input for frequency analysis.

By automatically adjusting the frequencies of the notch filter and band pass filter in this manner, it becomes possible to automatically adjust the characteristics of the control system, even if the casting condition is changed, so the periodical molten metal level fluctuations can be suppressed.

Then, a method of automatically setting the notch filter ratio g of the notch filter, the control gain $K_p$ of the controller and the phase compensation gain $K_g$ of the phase compensation part is described as follows.

For improving the precision of control and the speed of response, it is desirable to increase the control gain $K_p$ of the molten metal level controller. However, an excessively large control gain $K_p$ causes a problem whereby the molten metal level fluctuations increase. The adequate level of the control gain $K_p$ varies according to the casting conditions. Therefore, it is desirable that also the control gain $K_p$ be automatically adjusted. Further, it is desirable that the notch filter ratio g of the notch filter and the phase compensation gain $K_g$ of the phase compensation calculation part also be automatically adjusted for harmonizing the whole control system when the control gain $K_p$ varies.

Figure 20:
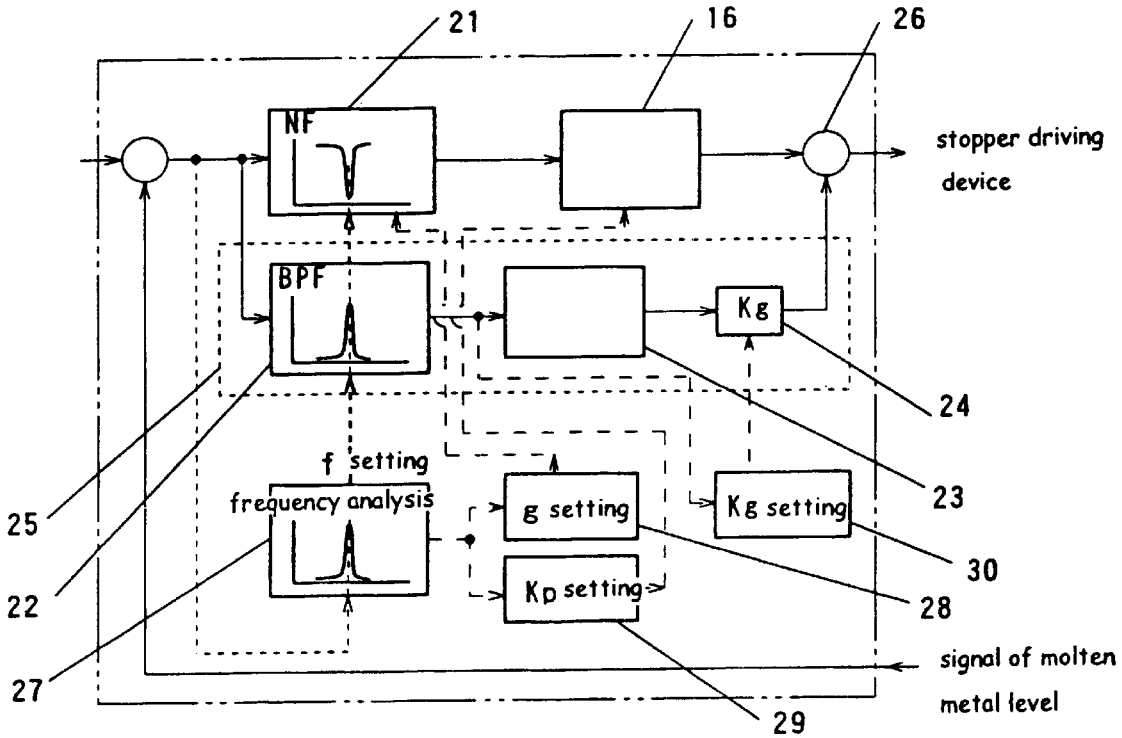
FIG. 20 is a block diagram illustrating the method of automatic setting of various gains in carrying out the method of the invention.

FIG. 20 is a block diagram showing a method of automatic setting of the notch filter ratio g, control gain $K_p$ and phase compensation gain $K_g$.

FIG. 20 shows a part of the block of FIG. 14, corresponds to the section enclosed by a chain double-dashed line. The symbol 28 indicates a notch filter ratio setting part, 29 a control gain setting part, and 30 a phase compensation gain setting part. The notch filter ratio setting part 28 sets the notch filter ratio g of the notch filter 21 according to the amplitude of periodical molten metal level fluctuations as obtained by the frequency analysis part 27, namely according to the peak height. The control gain setting part 28 sets the control gain $K_p$ according to the frequency of periodical molten metal level fluctuations as obtained by the frequency analysis part 27. The phase compensation gain setting part 30 sets the phase compensation gain $K_g$ while observing the output of the band pass filter 22.

In FIG. 20, the setting systems for g, $K_p$ and $K_g$ are shown as a setting system including, along a broken line, the frequency analyzing part 27, notch filter ratio setting part 28, and notch filter 21, a setting system including, along another broken line, the frequency analyzing part 27, control gain setting part 29 and control logic part 16, and a setting system including, along a further broken line, the band pass filter 22, phase compensation gain setting part 30 and phase compensation gain calculation part 24, respectively.

As for the other symbols, 23 indicates a phase compensator, 24 a phase compensation gain calculation part with a phase compensation gain $K_g$, 25 a phase compensation calculation part, 26 an output addition part, NF the notch filter, and BPF the band pass filter. In the following, a method of automatic setting is described in detail.

The method of setting the notch filter ratio g:

For cutting off disturbances to the notch frequency, adjusted to the frequency of periodical molten metal level fluctuations, the notch filter ratio according to this invention is effective only when it is less than 1. However, an excessively decreased notch filter ratio causes phase delays at frequencies lower than the notch frequency, which make the molten metal level control unstable. Therefore, when the periodical molten metal level fluctuations are great, the damping by the notch filter is increased, namely the notch filter ratio g is made smaller. When the molten metal level fluctuations are small, the damping is made less, the notch filter ratio is increased or no damping is effected, it is recommended that g=1.

Figure 21:
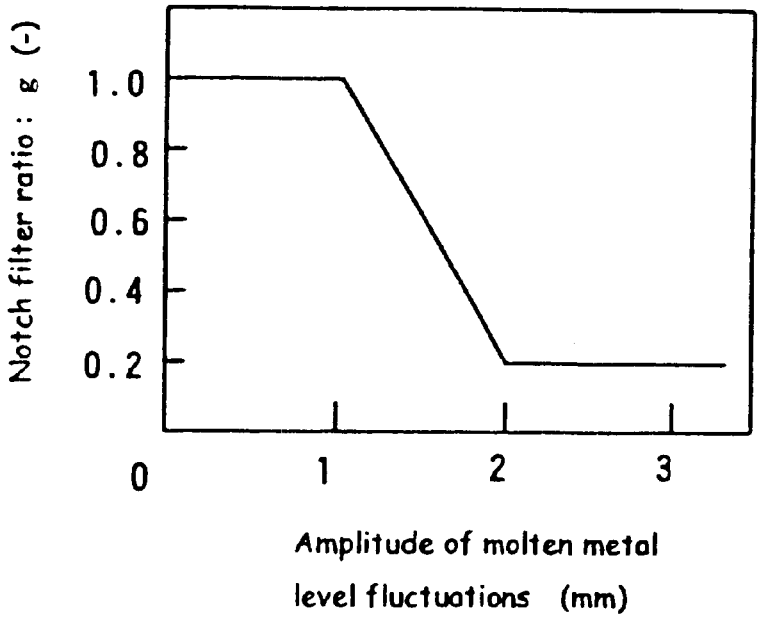
FIG. 21 is a graphic representation of an example of the relation between the frequency of molten metal level fluctuations and the notch filter ratio g of the notch filter in the practice of the invention.

FIG. 21 is a graphic representation of the relation between the amplitude of periodical molten metal level fluctuations and the notch filter ratio. There is shown an example of the method of determining the notch filter ratio g of the notch filter. When the periodical molten metal level fluctuations are great, when the amplitude is in excess of 2 mm as in the example shown in the figure, the notch filter ratio g is made small, 0.2, while, when the molten metal level fluctuations are small, when the amplitude is less than 1 mm as in the example shown in the figure, the notch filter ratio is made larger, 1.0. In order to avoid sudden changes, the notch filter ratio is varied in a slope-like manner in the section in which the amplitude of molten metal level fluctuations is 1 to 2 mm.

The method of setting the control gain $K_p$ of the molten metal level controller:

For adjusting $K_p$, attention is directed to the fluctuations at a relatively low frequency among the peak frequency components obtained from the results of frequency analysis of the molten metal level fluctuations. In many cases, periodical molten metal level fluctuations, caused by irregular bulging, have a frequency of not less than 0.2 Hz, while periodical molten metal level fluctuations, caused by eccentric pinch rolls and other eccentric rolls, have a frequency of around 0.1 Hz. Frequency components of 0.1 Hz or less reflect, in many cases, non-periodic or long-period molten metal level fluctuations which are caused, for instance, by submerged entry nozzle clogging or fluctuations in molten steel head height in the tundish.

In cases where there are peak components at 0.1 Hz and below in that manner and attempts are made to cut off fluctuations, caused by pinch roll eccentricity, from the control system by means of a notch filter, the phase delay, caused by the notch filter, greatly influences the control loop, acting in the direction toward increased and unstable molten metal level fluctuations. In that case, therefore, the control is prevented from becoming unstable by decreasing the control gain K , namely by sacrificing the response speed to some extent.

In cases where there are no level fluctuations due to pinch roll eccentricity in the vicinity of 0.1 Hz and the only object is to suppress irregular bulging-due molten metal level fluctuations, the notch frequency of the notch filter is in a high zone of 0.2 Hz or above and the influences of the phase delay become slight, hence the above problem does not arise.

Figure 22:
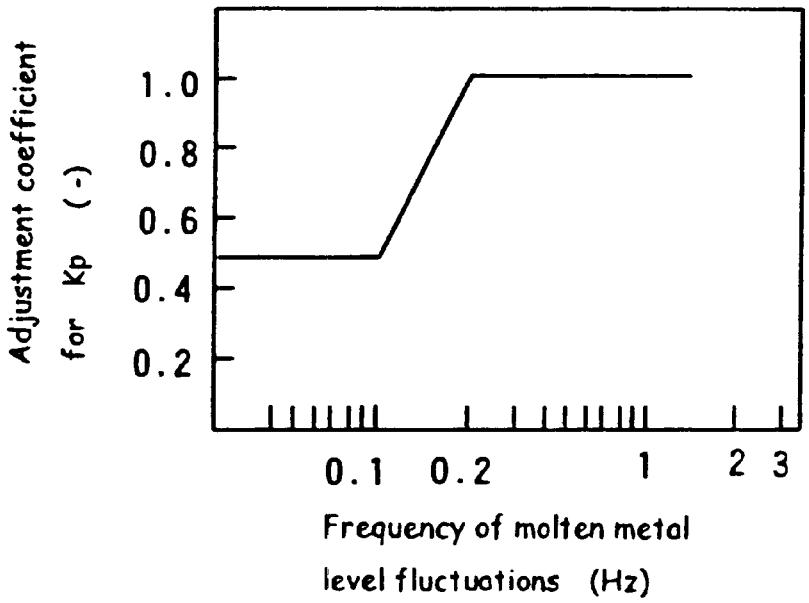
FIG. 22 is a graphic representation of an example of the relation between the frequency of molten metal level fluctuations and the adjustment coefficient for the control gain $K_p$ of the controller in the practice of the invention.

FIG. 22 is a graphic representation of the relation between the frequency of periodical molten metal level fluctuations and the adjustment coefficient for the control gain $K_p$ of the molten metal level controller. $K_p$ is made smaller when the lowest frequency of molten metal level fluctuations is smaller than 0.1 Hz and level fluctuations are found in the vicinity of 0.1 Hz and when a notch filter is inserted in the control system, and $K_p$ is maintained at the level of the reference control gain when the lowest frequency is not smaller than 0.2 Hz. Between 0.1 to 0.2 Hz, the adjustment coefficient is varied in a slope-like manner so that rapid changes may be avoided. Here, the reference control gain is the control gain of the molten metal level controller as adjusted using a steel grade, with which irregular bulging hardly occurs, for example in a low-carbon steel.

The method of setting the phase compensation gain $K_g$:

In the phase compensation calculation part a differential calculation is carried out as mentioned above. The differential calculation is effective in compensating the phase delay, because the controlling of the molten metal level fluctuations is made in the suppressing direction in advance, so the fluctuations may not increase. However, when minute high frequency fluctuations do exist in disturbance signals, for example, the differential calculation method intensifies the suppressing action and may causes increased fluctuations. Since such high frequency fluctuations vary according to the characteristics and constitutions of the respective apparatus and the devices in the actual process, and according to the process parameters intrinsic in the continuous casting machine, it is difficult to conduct the automatic setting procedure according to certain specific conditional formulas. In the practice of the present invention, an optimum value is found out by practicing the control by slightly increasing or decreasing the phase compensation gain of the phase compensation operation part, observing whether the molten metal level fluctuations at the relevant frequency increase or decrease as a result, and resetting the phase compensation gain so that the fluctuations may decrease. In an example, a trial and error method of determining the phase compensation gain of the phase compensation operation part is used as mentioned below.

An initial value of the phase compensation gain $K_g$ is set in advance for the phase compensation operation part and this value of the phase compensation gain $K_g$ is slightly increased or decreased to thereby carry out the molten metal level control and an evaluation is made as to whether the amplitude of the molten metal level deflection e is increased or decreased. When, as a result of increasing or decreasing the phase compensation gain $K_g$. the molten metal level fluctuations increase, the direction of the increase or decrease of $K_g$ is erroneous, hence $K_g$ is increased or decreased in the opposite direction. When the molten metal level fluctuations decrease as a result of the increase or decrease of the phase compensation gain $K_g$, the direction of adjustment of $K_g$ is in the correct direction and, therefore, $K_g$ is further increased or decreased in the same direction in search of an optimal value of $K_g$.

Such procedure is repeated a limited number of times and the optimum $K_g$, which minimizes the molten metal level fluctuations, is selected from among various values of $K_g$ obtained and is set as the new value of $K_g$. Or, it is also possible to repeat this procedure continuously in each run to thereby always maintain an optimal value of $K_g$.

It is desirable to carry out a comparative evaluation of the magnitude of molten metal level fluctuations by the mean square method which is easy in operational treatment.

In applying to an actual process, it is desirable that one calculation time amount to an integral multiple of the fundamental period T (s) of the band pass filter, namely of the reciprocal of the band pass frequency=$1/f_b$. For eliminating the influences of the transition stage, it is desirable that the mean square calculation in each trial be started after the lapse of at least one period T (s) following the preceding change of $K_g$. Since the optimization of the phase compensation gain is concerned with the phase compensation calculation part, it is desirable to calculate the mean square only for a specific frequency of molten metal level fluctuations, which is the band pass frequency, namely the components of the phase compensator frequency. Therefore, in the practice of this invention, the mean square of molten metal level fluctuations is observed and determined from the band pass filter output value $e_b$.

The following adaptive learning control method, for example, is suitable as a method of searching for an optimum value of $K_g$, which is the method in order to slightly vary the $K_g$.

Figure 23:
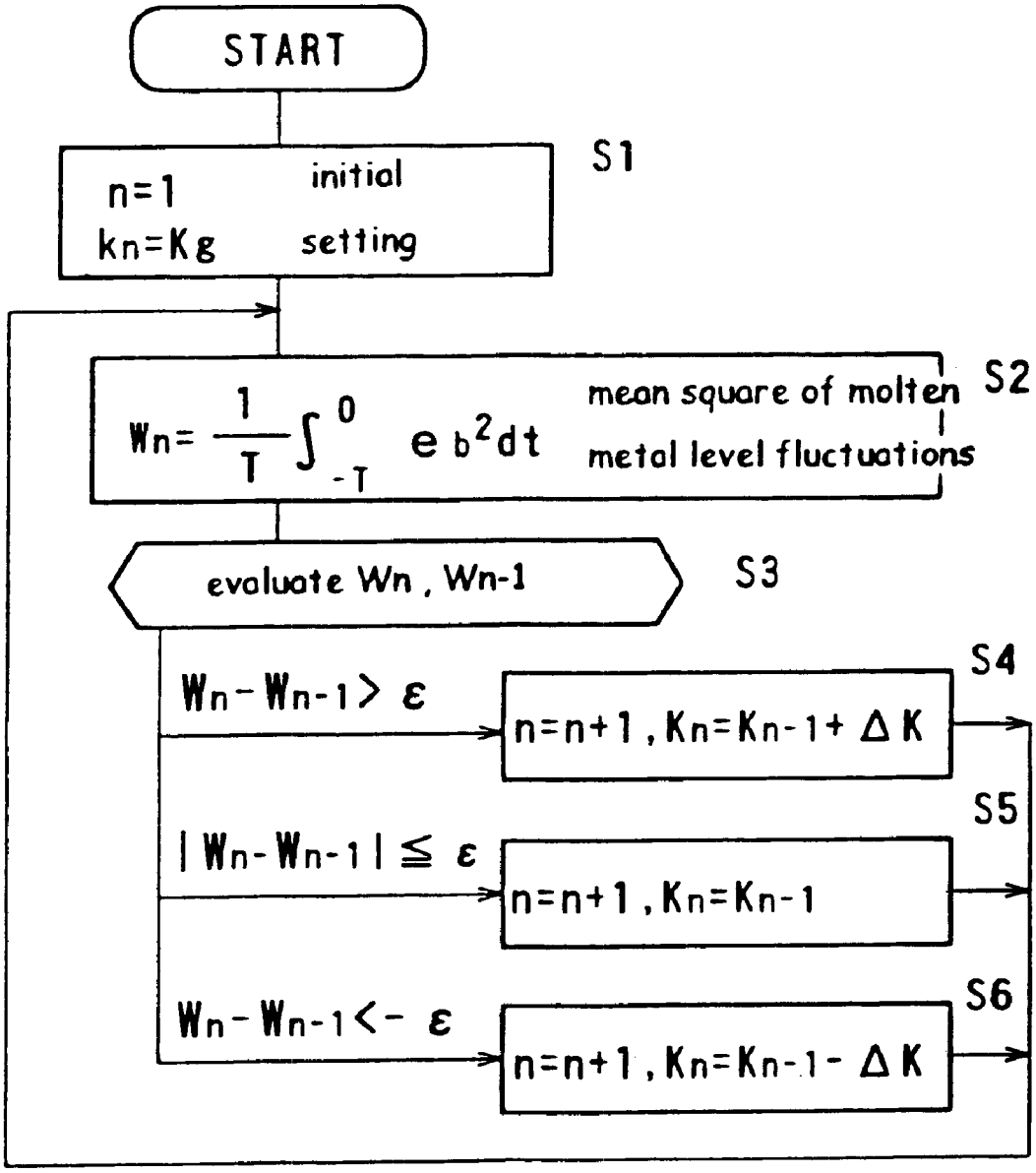
FIG. 23 is a flow chart illustrating an example of the method of setting the phase compensation gain $K_g$ in the practice of the invention.

FIG. 23 is a flow chart illustrating an example of the method of setting the phase compensation gain $K_g$ in the practice of the present invention. In step S1, initial settings are made. In step S2, the mean square of molten metal level fluctuations found during the past one period is calculated and, in step S3, it is evaluated. In step S4 or S6, when the mean square $W_n$ of molten metal level fluctuations is greater than the previous value $W_{n-1}$, namely when it is greater than the error range $\epsilon$, the value of $K_n$ is slightly increased and the control is continued. Conversely, when $W_n$ is smaller than the previous value $W_{n-1}$, the value of $K_n$ is slightly decreased. Step S5 corresponds to the case where an appropriate value of $K_g$ is set and no change is required. By carrying out the above procedure repeatedly, it becomes possible to always maintain an optimum value of $K_g$.

A method of disposing a plurality of phase compensation calculation parts in parallel, in which notch filter and phase compensation calculation part are incorporated in the control loop, is described in the following.

The peak frequency of periodical molten metal level fluctuations, due to irregular bulging or roll eccentricity, may contains a plurality of frequency components. As for the phase compensation calculation part as well, a plurality of phase compensation calculation parts, having one band pass frequency, are connected in parallel.

Figure 24:
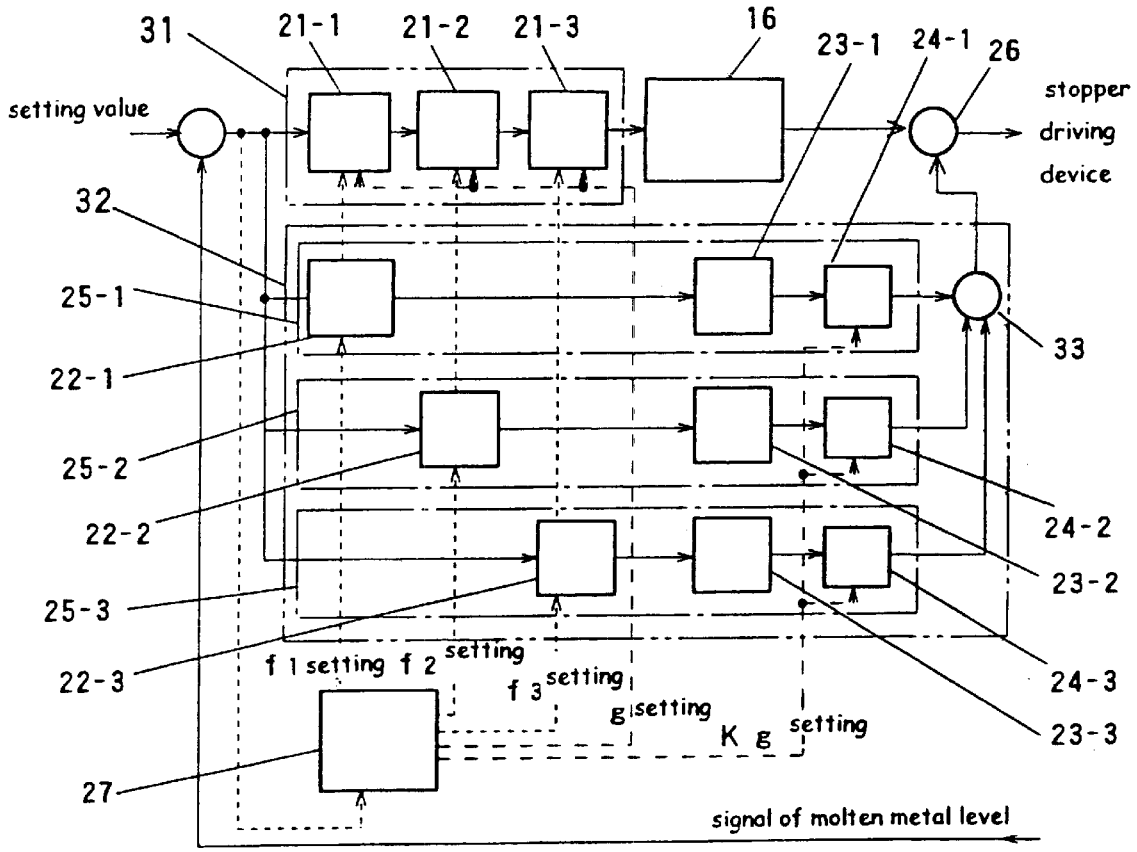
FIG. 24 is a block diagram illustrating a control system coping with a plurality of periodical molten metal level fluctuations in the practice of the invention.

FIG. 24 is a block diagram of a control system having a plurality of phase compensation calculatiuon parts connected in parallel. Only a part of the block of FIG. 14 which is enclosed by a chain double-dashed line is shown. The combined notch filter 31 is constituted of three notch filters 21-1, 21-2 and 21-3 connected in series. In this example, the combined phase compensation calculation part 32 is constituted of three phase compensation calculation parts 25-1, 25-2 and 25-3 and an adder 33 of the combined phase compensation calculation part. The molten metal level deflections are input to the three phase compensation calculation parts and the respective outputs are added up by the adder 33 of the combined phase compensation calculation part, and the phase compensation calculation parts 25-1, 25-2 and 25-3 are, as a whole, connected in parallel. The phase compensation calculator 25-1 is constituted of a band pass filter 22-1, a phase compensator 23-1 and a phase compensation gain calculation part 24-1. The phase compensation calculator 25-2 including 22-2, 23-2 and 24-2 and the phase compensation calculator 25-3 including 22-3, 23-3 and 24-3 are constituted in the same manner as the above 25-1. Further, the results of adding up by the adder 33 of the combined phase compensation calculation part are added to the output of the control logic part 16 by the output adder 26, to give a control signal to a stopper driving device.

By the automatic frequency setting function of the frequency analyzer 27 mentioned above, the notch frequency of the notch filter 21-1 is set at one frequency $f_1$ of the periodical molten metal level fluctuations and the band pass frequency of the band pass filter 22-1 is also set at the same periodic disturbance frequency $f_1$. Similarly, the frequencies of the notch filters 21-2, 21-3, and band pass filters 22-2, 22-3 are set at the frequencies $f_2$ and $f_3$ of other periodical molten metal level fluctuations. In FIG. 24, these automatic set up passes are indicated by dotted lines.

Further, a setting functions both of the above-mentioned automatic notch filter ratio g and phase compensation gain $K_g$ are performed for each of the notch filters 21-1, 21-2 and 21-3 and for each of the phase compensation gain calculation parts 24-1, 24-2 and 24-3. These automatic set up passes are shown by broken lines. However, the block, corresponding to the notch filter ratio setting part and the phase compensation gain setting part as shown in FIG. 20, is omitted and, in this figure, it is indicated that the settings of the respective notch filters and phase compensation gain calculation parts be directly made from the frequency analyzing part.

As a third concrete method of control, a control method in which a variable frequency oscillator is incorporated in the control loop, is now described.

When the frequency analysis in the control of periodical molten metal level fluctuations is carried out by the FFT technique, the peak frequencies to be detected are in the range of 0.1 to 0.5 Hz, as mentioned above. Among them, the frequencies of periodical molten metal level fluctuations due to irregular slab bulging are in the range of 0.2 to 0.5 Hz. The differences in roll gap (distance) in the secondary cooling zone are 10 to 15%. Therefore, it is essential for the resolution of the above frequency analysis to be about 0.02 Hz, and the number of samples required for FFT analysis amounts to not less than $2^9$, namely not less than 512. The sampling period for controlling purposes is generally about 0.1 second, hence the minimum period of time required for sampling amounts to 51.2 seconds.

On the other hand, in a continuous steel casting machine, the casting speed is increased or decreased after starting or at the end of the casting. In certain instances, the casting speed is increased or decreased also for the purposes of maintaining slab quality, timing adjustment between casting and rolling in roll mills and so forth. With the increase or decrease in casting speed or changes in slab cooling conditions, the crater end of solidifying varies, and then the frequencies of periodical molten metal level fluctuations suddenly change. To cope with these frequency changes, the FFT analysis requires about 50 seconds for data sampling, as mentioned above, and it is also desirable to study a method of reducing the sampling time as far as possible. From this viewpoint, the use of a variable frequency oscillator is desirable as an alternative device to the frequency analyzer 27. This technique is referred to also as "phase loop locked type frequency analysis" or "PLL (phase lock loop)".

Figure 25:
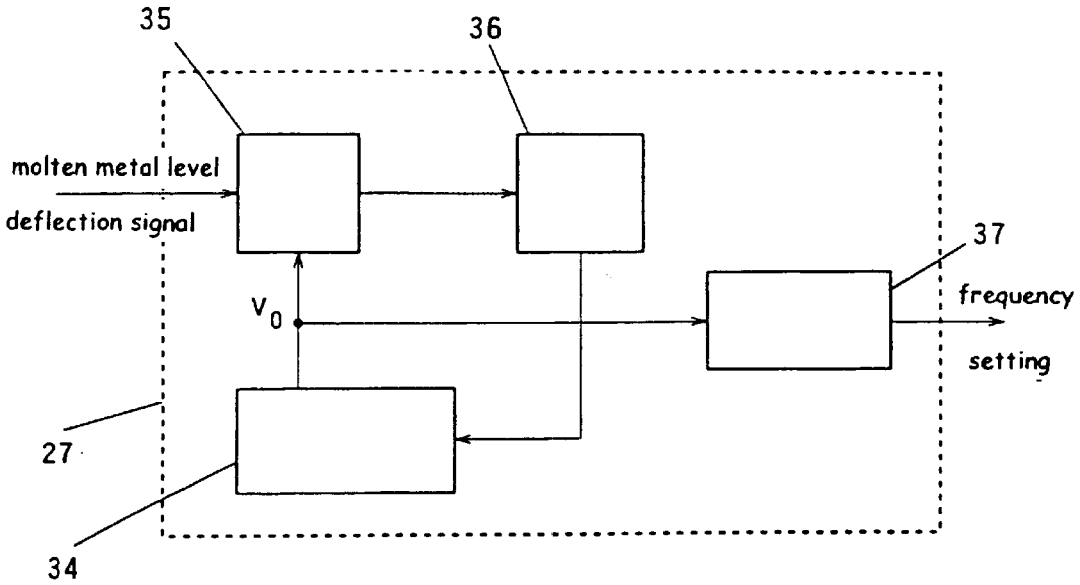
FIG. 25 is a block diagram illustrating a method of frequency analysis by the phase loop locked type frequency analyzing technique in the practice of the invention.

FIG. 25 is a block diagram of the frequency analysis method using the technique of phase loop locked type frequency analysis. The symbol 34 indicates a variable frequency oscillator, 35 a multiplier, 36 a low pass filter and 37 a frequency detector. The frequency analyzing part 27 comprises these devices described above. Molten metal level signals or molten metal level deflection signals, which include periodic disturbance frequencies, namely molten level fluctuation signals, are input to the frequency analyzing part 27 and, within the frequency analyzing part 27, they are input to the multiplier 35. On the other hand, a sine wave is input to the multiplier 35 from the variable frequency oscillator 34 and the results of multiplication are once passed through the low pass filter 36, whereby a beat component corresponding to the frequency difference between the molten metal level fluctuations and the variable frequency oscillator is extracted. According to this beat, namely the frequency difference signal value, the frequency of the variable frequency oscillator 34 is varied. The frequency detector 37 observes the output of the variable frequency oscillator 34. When the period of time from a time-point when the output becomes zero to the next time-point when it becomes zero, namely zero cross, is regarded as T/2 where T (s) is the period, and a frequency f=1/T is given. This frequency is the oscillation frequency of the variable frequency oscillator. When a molten metal level control system is constituted using the frequency analyzing part 27, the periodic disturbance frequency and the frequency of the variable frequency oscillator always coincides with, namely tune to, each other.

Figure 26:
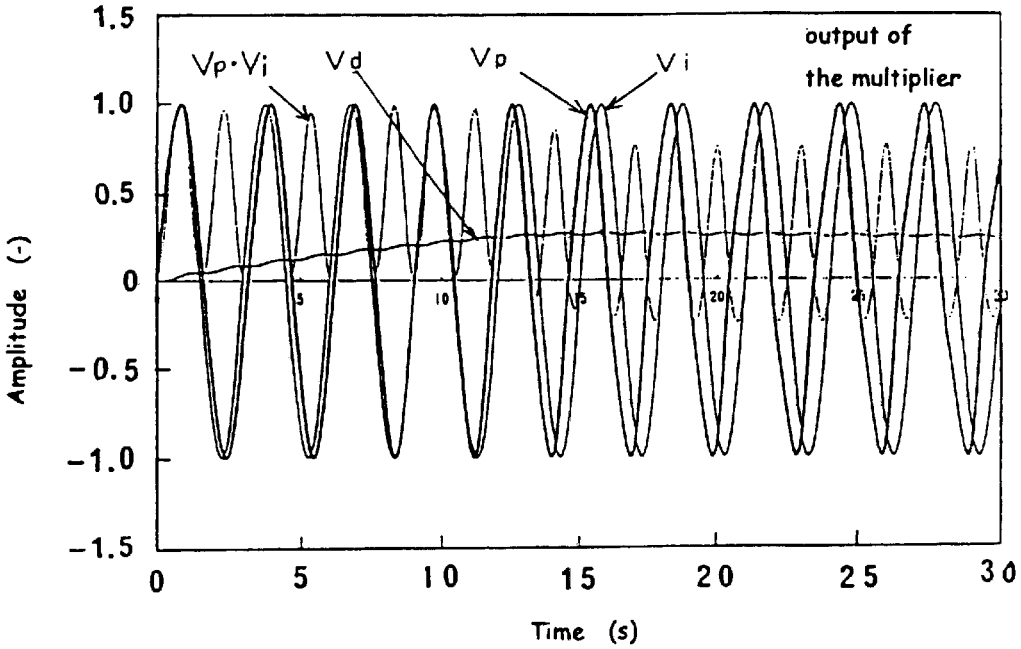
FIG. 26 is a graphic representation of the results of simulation of the state of tuning of the oscillation frequency of a variable frequency oscillator to a signal indicating periodical molten metal level fluctuations in the practice of the invention.

FIG. 26 shows the results of simulation of the condition in which the oscillation frequency of the variable frequency oscillator tunes to the frequency of the periodical molten metal level fluctuations. FIG. 26 shows the time courses of the input $v_i(t)=\sin(\omega_i t)$, which corresponds to the frequency of periodical molten metal level fluctuations, the output $v_p(t)=\sin((\omega_p t)$ of the variable frequency oscillator 34, the output of the multiplier 35 and the output of the low pass filter 36, as observed according to the block diagram shown in FIG. 25. At time 0, there is no phase difference but there is a frequency difference between $v_i$ and $v_p$. Thus, $f_p=\omega_p/2\pi=0.3$ Hz: variable, and $f_i=\omega_i/2\pi=0.33$ Hz: constant are shown. In the period from time 0 to time 5 s, $v_i$ and the output $v_d$ after passing the low pass filter both increase gradually and, at the same time, the phase difference between $v_p$ and $v_i$ increases gradually, hence the phase of $\omega_p$ becomes delayed gradually. At time 5 to time 15 s, the output $v_d$ after passing the low pass filter further increases and, at the same time, $\omega_p$ increases gradually and the enlargement of the phase difference decreases. At time 15 s and thereafter, the output $v_d$ after passing the low pass filter has an almost constant value, $\omega_p$ becomes almost equal to $\omega_i$ and the phase difference is maintained at a constant level. This is the tuned state.

By using the phase loop locked type frequency analyzing method, namely the PLL method, in the above manner, it is possible to detect the tuning in about 15 to 20 seconds and, therefore, periodical disturbance frequencies can be detected in a shorter period of time as compared with the frequency analysis by the FFT technique.

Then, the control apparatus according to the invention is described below.

Referring to the control apparatus of the present invention which is to be used in practicing the above control method of the present invention, the following elements can be used. As the molten metal level senser, an eddy current mold level detector in the ordinary use can be used, among others. As the FFT analyzer, a commercially available FFT analyzer or a program installed in a computer can be used and, as the automatic tuner for the results of FFT analysis, a controller having a setting device or a program installed in a computer can be used.

As the molten level controller, a PID controller in common use, a program installed in a computer or the like can be used. As the notch filter, an analogue operational amplifier including an inductance, capacitance and resistance or a program installed in a computer can be used to produce the effects of the present invention.

As the band pass filter, phase compensator and phase compensation gain calculation part, which constitute the phase compensation calculation part, an operational amplifier including an inductance, capacitance and resistance or a program installed in a computer can be used. As the adder of the combined phase compensation calculation part, a combination of such operational amplifiers connected in parallel or a program installed in a computer can be used. Further, as the variable frequency oscillator, an operational amplifier including an inductance, capacitance and resistance or a program installed in a computer can be used.

The method of continuous steel casting of steel is now described below.

In continuously casting a molten metal into the so-called rectangular slabs, used as materials for producing hot-rolled steel strip in coil or steel sheets, the slabs have a thickness of about 200 to 300 mm and the casting speed amounts to about 1 to 2 m/min. Such slab thickness is employed from the viewpoint of securing slab quality and productivity.

On the other hand, in recent years, in the field of production of steel strip in coil, in particular, it has become routine, from the viewpoint of reducing the production cost and equipment cost, to dispose a continuous casting machine and a simple hot rolling mill on one and the same production line. In such a continuous casting process, it is intended to cast slabs as thin as possible. When, for improving the slab surface quality, a rectangular and parallel mold is used according to the way of thinking about ordinary molds, slabs having a thickness of about 80 to 120 mm on the mold exit side are cast. The casting speed employed is about 3 to 5 m/min.

In the casting of slabs about 200 to 300 in thickness, periodical molten metal level fluctuations due to irregular slab bulging and/or periodical molten metal level fluctuations due to roll eccentricity still occur. These periodical molten metal level fluctuations can be controlled using the control method and the control apparatus of the present invention.

On the other hand, when slabs about 80 to 120 mm in thickness are cast, such periodical molten metal level fluctuations occur remarkably and, in some instances, make it difficult to continue the casting. The causes among others are the relatively thin slab thickness and high casting speed. Thus, since the casting speed is high, the thickness of the liquid core within the slab becomes relatively thick and therefore the slab shows a tendency toward easy bulging. Further, since the slab thickness is thin and the space above molten steel in the mold is small, the molten metal level in the mold readily fluctuate when changes occur in the volume of not-solidified molten steel within the slab as a result of the slab bulging. It is more desirable to apply the control method and control device of the present invention to cope with such periodical molten metal level fluctuations.

EXAMPLES

The following examples illustrate the present invention more concretely. These examples are, however, by no means limited to the scope of the invention.

Example 1

A test was performed to confirm the effects of this invention produced by incorporation of a notch filter in the control loop.

A steel grade containing, in mass percentage, C: 0.08%, Si: 0.5% and Mn: 1.2% was cast into a slab 90 mm in thickness and 1,350 mm in width. The casting speed was varied in the range of 3.0 to 8.0/min. A molten metal level fluctuation controlling device constituting the control loop shown in FIG. 7 was used. On that occasion, a single notch filter was used.

The guide roll constitution, namely roll pitch x number of rolls, in each roll segment in the secondary cooling zone of the continuous casting machine used was as follows: in the order from the place immediately below the mold: first segment: 160 mm×5, second segment: 177 mm×6, third to fifth segments: 210×6, and sixth to eighth segments: 250 mm×6. Under the above conditions, the site of the crater end of solidifying was found in the vicinity of the second to third rolls in the third segment.

As a test for comparison, the control apparatus and control method of this invention were not used in the initial stage of casting, namely the notch filter was not operated but the molten metal level control was performed by inputting the signal from a molten metal level detector directly to the molten metal level controller and the casting speed was successively increased from 3 m/min.

An FFT analyzer always checked the molten metal level signal and carried out frequency analysis and also calculated the parameters $K_p$, f, Q and g to be set in the notch filter and control logic part.

When the molten metal level fluctuations became great, the notch filter was operated to start a test example of this invention. On that occasion, parameters based on the newest data were set in the notch filter and control logic part.

Figure 27:
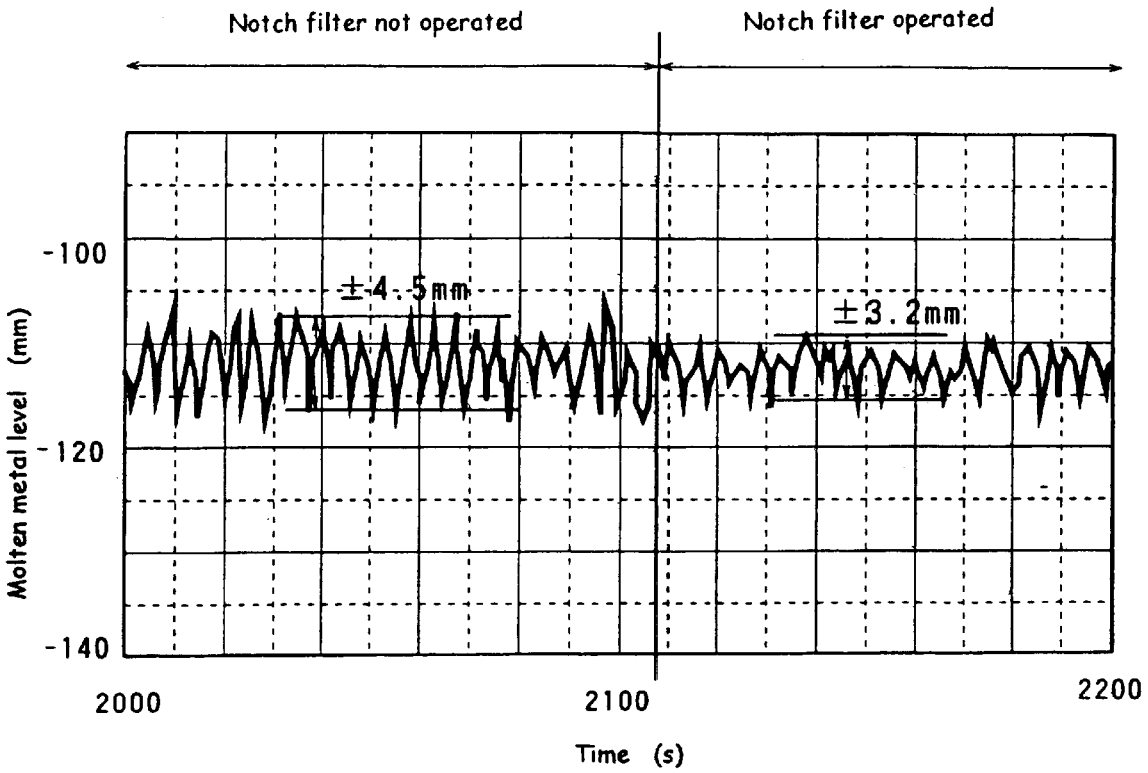
FIG. 27 is a graphic representation of the molten metal level fluctuations in a test casting.

FIG. 27 is a graphic representation of the molten metal level fluctuations in the casting test. The first half indicates the test results in the comparative example where the notch filter was not operated and the latter half indicates the test results in the example of the invention in which the notch filter was operated.

Figure 28:
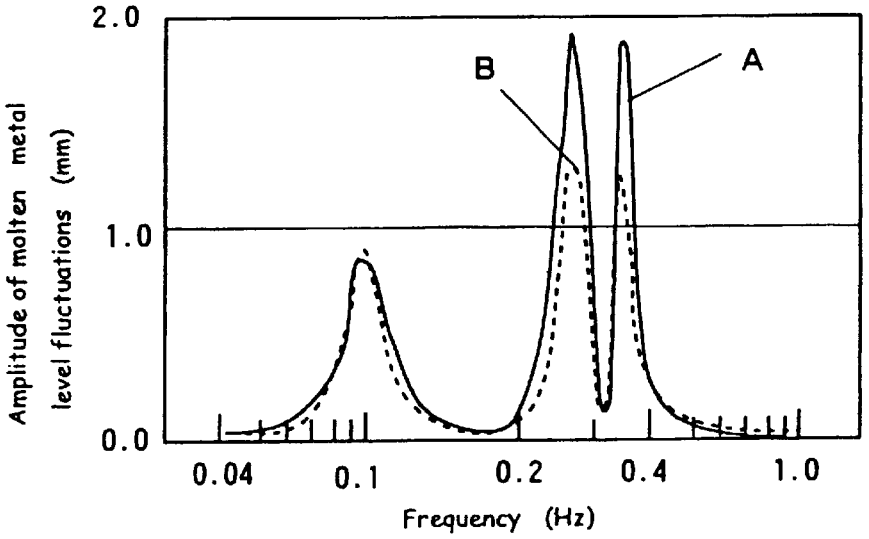
FIG. 28 is a frequency spectrum of molten metal level fluctuations.

FIG. 28 is a graphic representation of a frequency spectrum of molten metal level fluctuations. The spectrum A is the result of the comparative test example and the spectrum B is the result o the test example of this invention.

Both in the comparative test example and the test example of this invention, three peaks appeared with the same frequencies in both cases. The respective peak frequencies were: $f_1$: 0.098 Hz, $f_2$: 0.285 Hz and $f_3$: 0.333 Hz. Among these, $f_1$ is due to roll eccentricity in the secondary cooling zone and $f_2$ and $f_3$ are the frequencies resulting from irregular bulging.

The amplitude of molten metal level fluctuations at the frequency of 0.285 Hz was about 1.9 mm in the comparative test example while it was 1.5 mm in the test example of the present invention; the molten metal level control effect of the invention thus could be established.

Example 2

A simulated control experiment was carried out to confirm the effects of the present invention according to which a notch filter and a phase compensation operation part are incorporated in the control loop.

As an example of the invention, control simulation was performed using the control system shown in FIG. 14 referred to above. On that occasion, a single notch filter and a single phase compensation operation part were used. The casting conditions of the occasion of control simulation were as follows. Thus, the slab size was 90 mm in thickness and 1,200 mm in width and the casting speed was 3.0 m/min. The roll pitch for the rolls in the secondary cooling zone was 200 mm.

For comparing the control method of this invention with a prior art technology, control simulation was also performed using the control system comprising the molten metal level controller alone, as shown in FIG. 3. The control system gain of the whole control loop in the prior art control system became maximum at 0.25 Hz, as shown in FIG. 6. The control parameters of the molten metal level controller in the example of this invention, namely the control gain and integral time, were the same as those in the prior art example.

The notch frequency f of the notch filter 21 in FIG. 14 and the band pass frequency $f_b$ of the band filter 22 were adjusted to 0.25 Hz calculated from the casting speed and roll pitch, and the following set values were used: notch filter ratio g=0.2, molten metal level controller control gain $K_p$=1.0, and phase compensation gain $K_g$=0.8.

Supposing molten metal level fluctuations occurring on a continuous casting machine for producing slabs about 80–120 mm in thickness, molten metal volume fluctuations corresponding to a periodical molten metal level fluctuation frequency $f_2$: 0.25 Hz, namely a frequency corresponding to the value obtained by dividing the casting speed by the roll pitch, and an amplitude of 1,080 $cm^3/s$, namely molten metal volume fluctuations corresponding to a molten metal level of ±10 mm, were applied to the control system. This frequency corresponds to the resonance frequency of the control system in the prior art technology.

Figure 29:
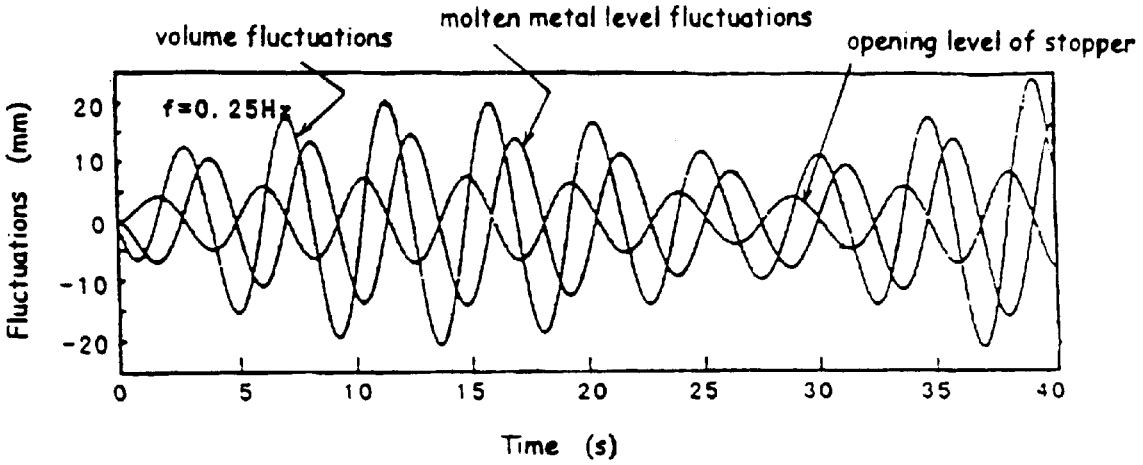
Fig. 29 PRIOR ART
FIG. 29 is a graphic representation of the results of control by a prior art technology.

FIG. 29 shows the results of the control simulation by the prior art technology.

Figure 30:
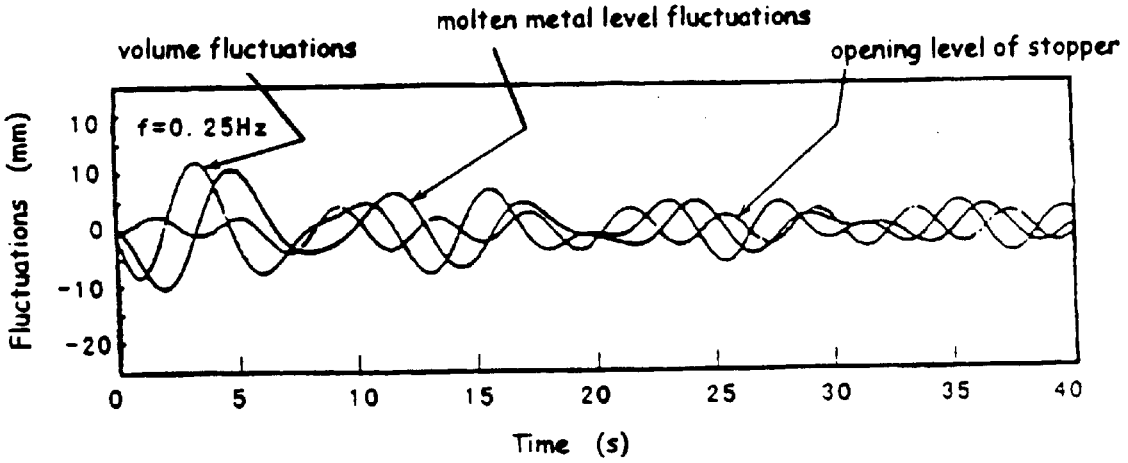
FIG. 30 is a graphic representation of the results of control according to the invention.

FIG. 30 shows the results of the control simulation by the invention.

According to the control simulation results obtained by the prior art technology in FIG. 29, the above applied volume fluctuations appeared as molten metal level fluctuations of about ±20 mm. On the contrary, the control by the prior art technology suppressed the molten metal level fluctuations to approximately ±15 mm. However, such extent of molten metal level fluctuations may still cause poor slab quality or breakout in the actual process of continuous casting.

According to the control simulation results obtained in accordance with the invention, as shown in FIG. 30, molten metal level fluctuations of about ±10 mm were observed initially but, after the lapse of about 10 seconds following the start of the control, the fluctuations could be suppressed to the range of ±5 mm. Such extent of molten metal level fluctuations is within a favorable range of molten metal level fluctuations in the actual process of continuous casting.

Example 3

Using the control system shown in FIG. 24 referred to above, control simulation was performed for the case of automatic parameter settings for a control system in which periodical molten metal level fluctuations, due to irregular bulging and to pinch roll eccentricity coexisted, and in which the frequency of molten metal level fluctuations, due to irregular bulging, varies.

As shown in FIG. 24, the objects of automatic settings were the notch filter frequency, the band pass filter frequency and the control gain of the molten metal level controller as well as the notch filter ratio and the phase compensation gain.

Figure 1:
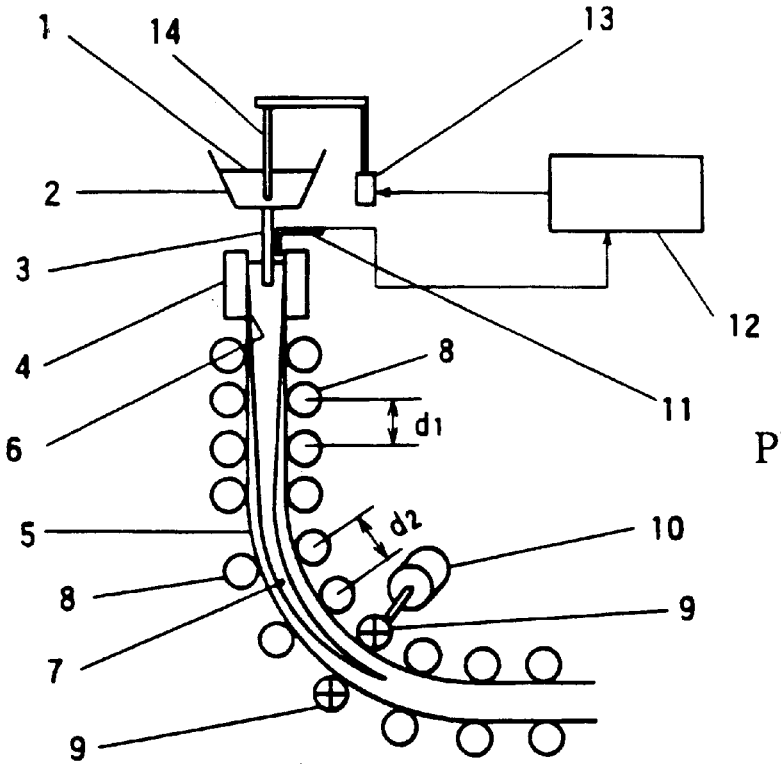
FIG. 1 is a schematic representation of a molten metal level control system in a continuous casting machine.
Figure 2A:
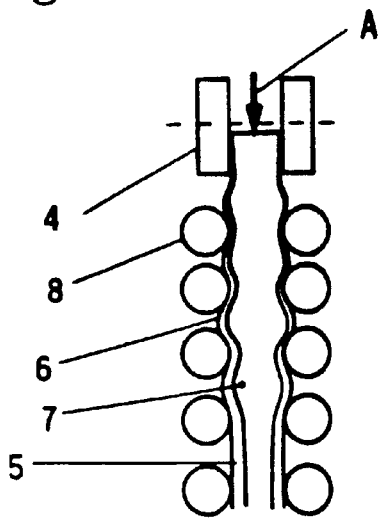
PRIOR ART Fig. 2A
FIG. 2A is a schematic view illustrating how irregular bulging occurs.
Figure 2B:
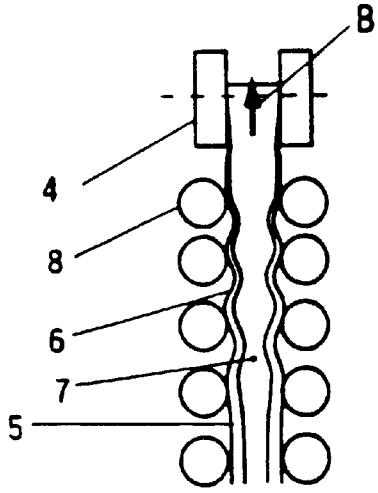
PRIOR ART Fig. 2B
FIG. 2B is a schematic view illustrating how irregular bulging occurs.

The casting conditions in the control simulation were as follows. The slab size was 90 mm in thickness and 1,200 mm in width, and the casting speed $V_c$ was 2.0 to 5.0 m/min. Two roll pitches were employed in the secondary cooling zone, as shown in FIG. 1, namely $d_1$=200 mm and $d_2$=250 mm. The pinch roll diameter $R_{sc}$ was 100 mm.

The frequencies and amplitudes of periodical molten metal level fluctuations were respectively as follows: $f_1$: $V_c/2\pi R_{sc}$=0.05 to 0.13 Hz, 2 mm; $f_2$: $V_c/d_1$=0.17 to 0.42 Hz, 3 mm; $f_3$: $V_c/d_1$=0.13 to 0.33 Hz, 3 mm.

In the simulation, the case was supposed in which the casting speed was increased successively from the start of casting, during which irregular bulging due to the roll pitch $d_1$ occurred at time T1 and then irregular bulging, due to $d_2$, overlapped at time T2 and, further, periodical disturbances occurred due to pinch roll eccentricity.

Figure 31:
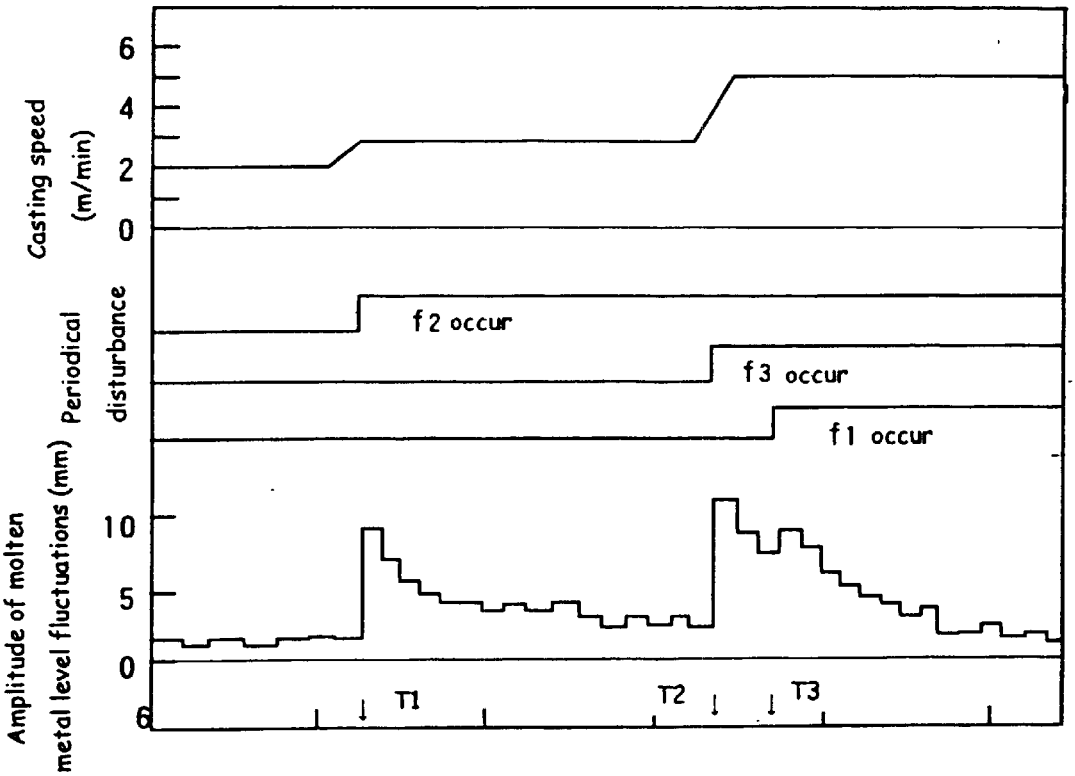
FIG. 31 is a graphic representation of the results of control by means of automatic set up functions in the practice of the invention.

FIG. 31 shows the control results obtained by the automatic setting functions of the present invention. Initially, when no irregular bulging occurred, the molten metal level, namely the root mean square of molten metal level deflections at 4-second intervals, was stable but, at time T1, when the first irregular bulging occurred, the molten metal level fluctuations increased. After a while, the control parameters were optimized and the molten metal level fluctuations decreased. At time T2, when irregular bulging newly occurred, the molten metal level fluctuations increased but, after a while, they became stable. Then, at time T3, when periodical molten metal level fluctuations occurred due to pinch roll eccentricity, the frequency of periodic molten metal level fluctuations increased slightly but the fluctuations soon became stable.

This control simulation revealed that changes in conditions of periodical molten metal level fluctuations in which a plurality of frequencies are present can be coped with as well by automatically setting, according to the invention, such parameters as the notch frequencies, the control gain of the molten metal level controller by means of the FFT technique.

Example 4

The automatic notch frequency and band pass frequency settings by the FFT analysis method in accordance with this invention were compared, by simulation, with the same automatic settings by the phase loop locked type frequency analyzing method using a variable frequency oscillator also in accordance with the invention.

For both the FFT analysis method and phase loop locked type frequency analyzing method, namely the PLL method, the casting conditions used for the simulation were as follows.

The casting conditions in the control simulation were as follows. The slab size was 90 mm in thickness and 1,200 mm in width, the roll pitch in the secondary cooling zone was 180 mm. The casting speed was raised from 3.0 m/min to 3.6 m/min over 10 seconds. Therefore, the frequency of periodical molten metal level fluctuations due to irregular bulging increased from 0.278 Hz to 0.333 Hz.

Figure 32:
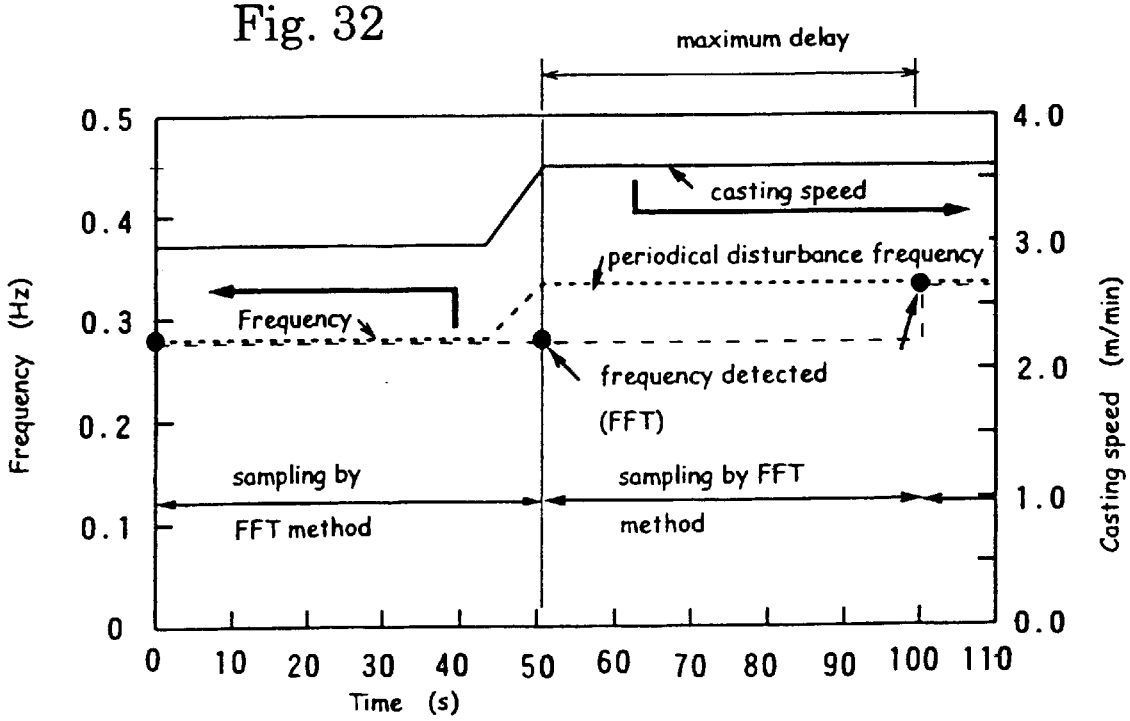
FIG. 32 is a graphic representation of the casting speed and periodical molten metal level fluctuation frequency conditions found upon simulation by the FFT technique in the practice of the invention.

FIG. 32 shows the casting speed and periodical disturbance frequency conditions in the simulation of the FFT method in accordance with the invention. When the FFT method was used, sampling for frequency analysis was started from time 0. However, the casting speed changed before completion of the collection of 512 samples, and the frequency of periodical molten metal level fluctuations changed. At the point of time of completion of the sampling period, the frequency detected had the value before acceleration of the casting speed and the frequency after change was detected first at the end of the next sampling period.

Figure 33:
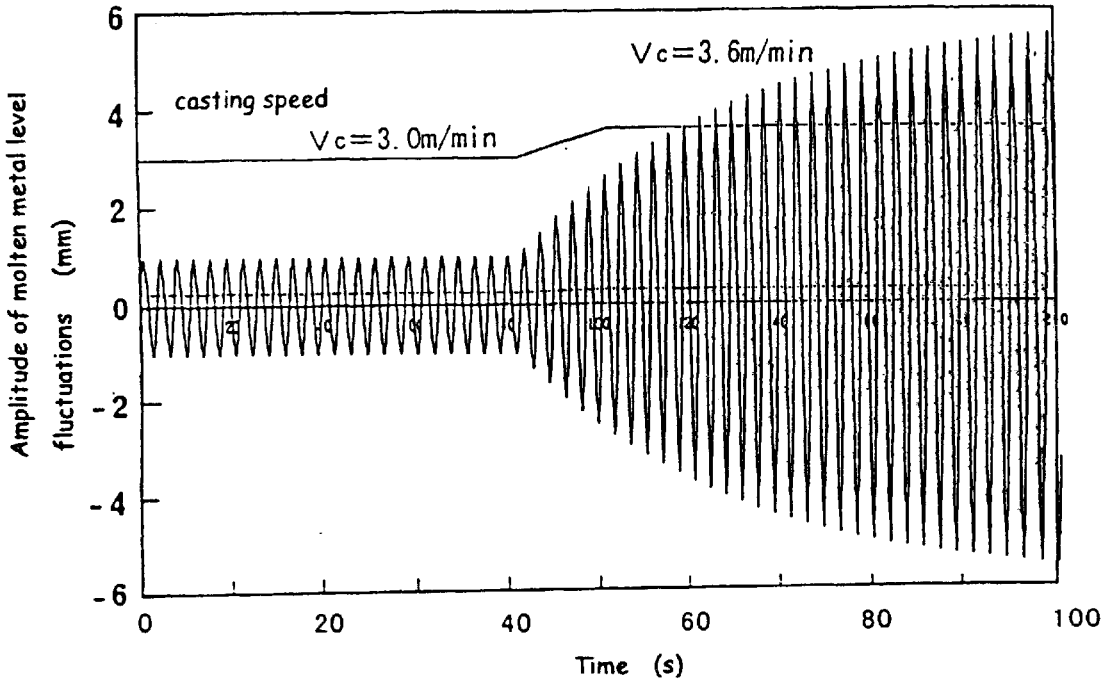
FIG. 33 is a graphic representation of the molten metal level fluctuations found by the FFT technique in the practice of the invention.

FIG. 33 shows the molten metal level fluctuations obtained by the FFT method. The amplitude of the molten metal level fluctuations was initially about 1 mm but rapidly increased from t=40 s, when the casting speed Vc began to increase and, at around t=100 s, the amplitude reached about 5.5 mm.

Figure 34:
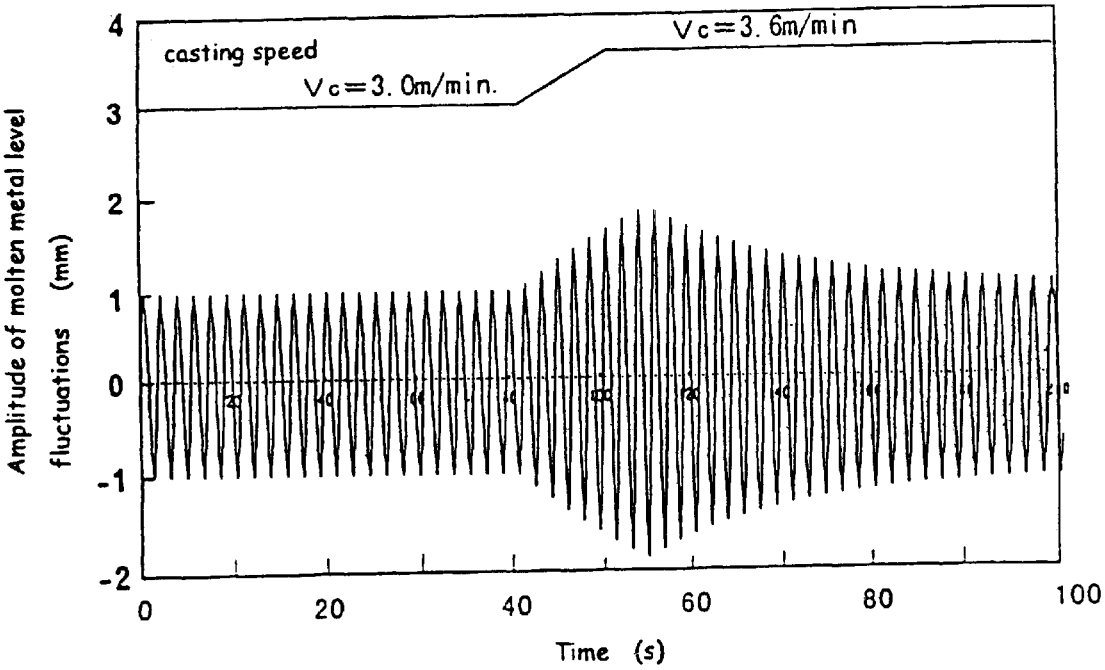
FIG. 34 is a graphic representation of the molten metal level fluctuations found by the PLL technique in the practice of the invention.

FIG. 34 shows the molten metal level fluctuations obtained by the PLL method. The amplitude of the molten metal level fluctuations was initially about 1 mm but increased from the time-point when the casting speed Vc began to increase. However, after arriving at the maximum amplitude of 1.8 mm at t=about 55 s, the amplitude gradually decreased and, at t=100 s, the original amplitude was restored.

As is seen from the above comparison, the phase loop locked type frequency analyzing method using a variable frequency oscillator, namely the PLL method, makes it possible to perform the molten metal level control more stable according to the invention.

Industrial Applicability

By applying the control method and control apparatus of this invention, it is possible to effectively control the periodical molten metal level fluctuations due to irregular bulging or roll eccentricity on the occasion of continuous steel casting. Even when the frequency of periodical molten metal level fluctuations changes with time, the control system parameters can be optimized without delay even in the case of high-speed casting. This invention is effective in casting a molten metal into rectangular slabs and more effective in casting a molten metal into rectangular slabs about 80–120 mm in thickness, in particular.

What is claimed is:

1. A method of controlling the level of molten metal in a mold for continuous casting by using a molten metal level control loop thereof, which comprises the steps of predetermining a frequency or frequencies of periodic molten metal level fluctuations, and damping selectively the predetermined frequency or frequencies of periodical molten metal level fluctuations through a notch filter installed in the control loop.

2. A method as defined in claim 1, wherein the notch filter comprises a plurality of notch filters connected in series and each of them is capable of selectively damping one frequency component, respectively, among the frequencies of the periodical molten metal level fluctuations; or comprises a single notch filter which is capable of damping the frequency components of the periodical molten metal level fluctuations over a band covering the respective frequencies of the periodical molten metal level fluctuations.

3. A method as defined in claim 1, which further comprises the steps of:

analyzing the signals of the molten metal level in the mold by a frequency spectrum analysis on the real time basis;

extracting a plurality of frequencies of the periodical molten metal level fluctuations and the amplitudes thereof; and, setting, based on these frequencies and amplitudes, the notch frequency or frequencies, notch filter ratio and band coefficient of the notch filter, as well as the proportional gain of the molten metal level controller.

4. A method as defined in claim 2, which further comprises the steps of:

analyzing the signals of the molten metal level by a frequency spectrum analysis on the real time basis;

extracting a plurality of frequencies of the periodical molten metal level fluctuations and the amplitudes thereof; and, setting, based on these frequencies and amplitudes, the notch frequency or frequencies, notch filter ratio and band coefficient of the notch filter, as well as the proportional gain of the molten metal level controller.

5. The method of claim 1, wherein the step of predetermining the frequency or frequencies of molten metal level fluctuations is based on fluctuations caused by one or more of irregular bulging, roll eccentricity, and irregular slab surfaces during a casting operation.

6. A method of controlling the level of the molten metal in a mold for continuous casting by using a molten metal level control system incorporating a molten metal level controller in the control loop thereof, which comprises the steps of:

predetermining a frequency or frequencies of periodic molten metal level fluctuations;

damping selectively the predetermined frequency or frequencies of periodical molten metal level fluctuations through a notch filter installed in the control loop;

inputting the molten metal level deflections to a phase compensation calculation part constituted which is made by connecting, in series, a band pass filter selectively transmitting the fluctuating component of a specific band pass frequency or frequencies and being adjusted so that the band pass frequencies include the frequency or frequencies of periodical molten metal level fluctuations, a phase compensator adjusted so that the phase compensation frequency or frequencies include a predetermined frequency or frequencies of periodical molten metal level fluctuations, and a phase compensation gain calculation part multiplying the input signal by a phase compensation gain and outputting the product; and, adding the output of said phase compensation calculation part to an output calculated by the molten metal level controller.

7. A method as defined in claim 6, wherein the notch filter comprises a plurality of notch filters connected in series and each of them is capable of selectively damping one frequency component, respectively, among the frequencies of periodical molten metal level fluctuations; or comprises a single notch filter, which is capable of damping the frequency components of the periodical molten metal level fluctuations over a band covering the respective frequencies of the periodical molten metal level fluctuations, and the combined phase compensation calculation part incorporating a plurality of phase compensation calculation parts connected in parallel, and at least one adder provided in the combined phase compensation calculation part.

8. A method as defined in claim 6, which further comprises the steps of:

analyzing the signals of the molten metal level in the mold by a frequency spectrum analysis on the real time basis;

extracting a plurality of frequencies of periodical molten metal level fluctuations and the amplitudes thereof; and, setting, based on these frequencies and amplitudes, the notch frequency or frequencies, notch filter ratio and band coefficient of the notch filter, as well as the proportional gain of the molten metal level controller and the phase compensation gain.

9. A method as defined in claim 7, which further comprises the steps of:

analyzing the signals of the molten metal level in the mold by a frequency spectrum analysis on the real time basis;

extracting a plurality of frequencies of the periodical molten metal level fluctuations and the amplitudes thereof; and, setting, based on these frequencies and amplitudes, the notch frequency or frequencies, notch filter ratio and band coefficient of the notch filter, as well as the proportional gain of the molten metal level controller and the phase compensation gain.

10. A method as defined in claim 1, which further comprises the steps of:

detecting a signal of a variable frequency oscillator in the control loop of the molten metal level control system;

multiplying, on the real time basis, the signals of the molten metal level fluctuations by the signal of the variable frequency oscillator, in determining the frequency or frequencies of the periodical molten metal level fluctuations beforehand;

changing the oscillation frequency of the variable frequency oscillator, based on the molten metal level fluctuations obtained from the results of multiplication, and on the signal of the difference between the frequency or frequencies gained by the multiplying and the frequencies of the variable frequency oscillator; and, determining the frequency of the periodical molten metal level fluctuations by tuning the oscillation frequency to the frequency of the molten metal level fluctuations.

11. A method as defined in claim 6, which further comprises the steps of:

detecting a signal of a variable frequency oscillator in the control loop of the molten metal level control system;

multiplying, on the real time basis, the signals of the molten metal level fluctuations by the signal of the variable frequency oscillator, in determining the frequency or frequencies of the periodical molten metal level fluctuations beforehand, changing the oscillation frequency of the variable frequency oscillator, based on the molten metal level fluctuations obtained from the results of multiplication, and on the signal of the difference between the frequency or frequencies gained by the multiplying and the frequencies of the variable frequency oscillator; and, determining the frequency of the periodical molten metal level fluctuations by tuning the oscillation frequency to the frequency of the molten metal level fluctuations.

12. The method of claim 6, wherein the step of predetermining the frequency or frequencies of molten metal level fluctuations is based on fluctuations caused by one or more of irregular bulging, roll eccentricity, and irregular slab surfaces during a casting operation.

13. An apparatus of controlling the level of the molten metal level in a mold for continuous casting, which comprises, in the control system thereof, a molten metal level sensor, an FFT analyzer, an automatic tuning device for dealing with the results of the FFT analysis, a molten metal level controller and a notch filter.

14. An apparatus defined in claim 13, wherein the notch filter comprises a plurality of notch filters connected in series and each of them is capable of selectively damping one frequency component, respectively, among the frequencies of periodical molten metal level fluctuations; or comprises a single notch filter capable of damping the frequency components of the periodical molten metal level fluctuations over a band covering the respective frequencies of the periodical molten metal level fluctuations.

15. An apparatus as defined in claim 13, wherein the control system further comprises a phase compensation calculation part consisting of a band pass filter, a phase compensator and a phase compensation gain calculating part.

16. An apparatus as defined in claim 15, wherein the notch filter comprises a plurality of notch filters connected in series and each of them is capable of selectively damping one frequency component, respectively, among the frequencies of the periodical molten level fluctuations; or comprises a single notch filter which is capable of damping the frequency components of the periodical molten metal level fluctuations over a band covering the respective frequencies of the periodical molten metal level fluctuations, and the combined phase compensation calculation part incorporating a plurality of phase compensation calculation parts connected in parallel, and at least one adder provided in the combined phase compensation calculation part.

17. The apparatus of claim 13, wherein the FFT analyzer and the automatic tuning device predetermine a frequency or frequencies of periodic molten metal level fluctuations, and the notch filter selectively damps the predetermined frequency or frequencies of the periodic molten metal level fluctuations.

18. The apparatus of claim 17, wherein the periodic molten metal level fluctuations are caused by one or more of irregular bulging, roll eccentricity, and irregular slab surfaces during a casting operation.

19. An apparatus of controlling the level of the molten metal in a mold for continuous casting, which comprises, in the control loop of the molten metal level control system thereof, a molten metal level sensor, a molten metal level controller and a notch filter, and further comprises, in the control loop, a frequency analyzing part consisting of a variable frequency oscillator, a multiplier, a low pass filter and a frequency detector.

20. An apparatus as defined in claim 19, wherein the control system further comprises a phase compensation calculation part incorporating a band pass filter, a phase compensator and a phase compensation gain calculating part.

21. A method of continuous casting of steel, which comprises casting a molten metal into slabs which are rectangular in shape using the method as defined in claim 1.

22. A method of continuous casting of steel, which comprises casting a molten metal into slabs which are rectangular in shape using the method as defined in claim 6.

23. The apparatus of claim 19, wherein the molten metal level controller predetermines a frequency or frequencies of periodic molten metal level fluctuations, and the notch filter selectively damps the predetermined frequency or frequencies of the periodic molten metal level fluctuations.

24. The apparatus of claim 23, wherein the periodic molten metal level fluctuations are caused by one or more of irregular bulging, roll eccentricity, and irregular slab surfaces during a casting operation.

25. The method of continuous casting of steel, which comprises casting a molten metal into slabs which are rectangular in shape using an apparatus which has a control system for controlling the level of the molten metal level in a mold for continuous casting, the control system including a molten metal level sensor, an FFT analyzer, an automatic tuning device for dealing with the results of the FFT analysis, a molten metal level controller and a notch filter.

26. The method of continuous casting of steel, which comprises casting a molten metal into slabs which are rectangular in shape using an apparatus which has a control system for controlling the level of the molten metal level in a mold for continuous casting, a control loop of the molten metal level control system thereof including a molten metal level sensor, a molten metal level controller and a notch filter, a frequency analyzing part consisting of a variable frequency oscillator, a multiplier, a low pass filter and a frequency detector.

27. A method of continuous casting of steel, which comprises casting a molten metal into slabs which are rectangular in shape and 80 to 120 mm in thickness, using the method as defined in claim 1.

28. A method of continuous casting of steel, which comprises casting a molten metal into slabs which are rectangular in shape and 80 to 120 mm in thickness, using the method as defined in claim 6.

29. The method of continuous casting of steel, which comprises casting a molten metal into slabs which are rectangular in shape and 80 to 120 mm in thickness, using an apparatus which has a control system for controlling the level of the molten metal level in a mold for continuous casting, the control system including a molten metal level sensor, an FFT analyzer, an automatic tuning device for dealing with the results of the FFT analysis, a molten metal level controller and a notch filter.

30. The method of continuous casting of steel, which comprises casting a molten metal into slabs which are rectangular in shape and 80 to 120 mm in thickness, using an apparatus which has a control system for controlling the level of the molten metal level in a mold for continuous casting, a control loop of the molten metal level control system thereof including a molten metal level sensor, a molten metal level controller and a notch filter, a frequency analyzing part consisting of a variable frequency oscillator, a multiplier, a low pass filter and a frequency detector.

* * * * *